US009670706B2

(12) United States Patent
Ching

(10) Patent No.: US 9,670,706 B2
(45) Date of Patent: Jun. 6, 2017

(54) PORTABLE DOOR GUARD HINGE SECURITY DEVICE

(71) Applicant: Henry Kong Sun Ching, Alberta (CA)

(72) Inventor: Henry Kong Sun Ching, Alberta (CA)

( * ) Notice: Subject to any disclaimer, the term of this patent is extended or adjusted under 35 U.S.C. 154(b) by 220 days.

(21) Appl. No.: 14/320,692

(22) Filed: Jul. 1, 2014

(65) Prior Publication Data

US 2015/0008684 A1 Jan. 8, 2015

Related U.S. Application Data

(60) Provisional application No. 61/842,143, filed on Jul. 2, 2013.

(51) Int. Cl.
*E05C 19/18* (2006.01)
*E05D 11/00* (2006.01)

(52) U.S. Cl.
CPC ..... *E05C 19/184* (2013.01); *E05D 11/00* (2013.01); *E05Y 2201/418* (2013.01); *E05Y 2800/692* (2013.01); *E05Y 2900/132* (2013.01); *Y10T 292/34* (2015.04)

(58) Field of Classification Search
CPC ..... E05C 17/00; E05C 17/025; E05C 17/02; E05C 17/20; E05C 17/30; E05D 11/105; E05D 11/0027
USPC ..... 292/288, DIG. 15; 16/82, 86 B; 49/383
See application file for complete search history.

(56) References Cited

U.S. PATENT DOCUMENTS

| | | | | |
|---|---|---|---|---|
| 2,586,757 | A * | 2/1952 | Wummel | E05D 11/06 16/250 |
| 3,863,968 | A | 2/1975 | Fraser | |
| 4,771,506 | A | 9/1988 | Allen | |
| 5,056,836 | A | 10/1991 | Wells | |
| 5,340,173 | A | 8/1994 | Bethel | |
| 5,560,080 | A * | 10/1996 | Reed | E05D 11/0018 16/374 |
| 5,605,364 | A | 2/1997 | Shelledy | |
| 5,642,910 | A * | 7/1997 | Betherum | E05C 17/025 16/319 |
| 5,676,410 | A | 10/1997 | Angerbrandt | |
| 5,881,431 | A * | 3/1999 | Pieper, II et al. | E05D 11/06 16/374 |
| 6,161,252 | A | 12/2000 | Rodriguez | |
| 6,327,878 | B1 | 12/2001 | Levenson | |
| 6,702,341 | B1 * | 3/2004 | Hudelson et al. | E05D 11/0018 292/288 |
| 6,883,205 | B2 | 4/2005 | Martinez-Munoz | |
| 7,905,525 | B2 | 3/2011 | Badia | |
| 2008/0276421 | A1 | 11/2008 | Vanderpan | |
| 2010/0275414 | A1 | 11/2010 | Stots | |

* cited by examiner

*Primary Examiner* — Mark Williams
(74) *Attorney, Agent, or Firm* — Antonio Papageorgiou; Meister Seelig & Fein LLP

(57) ABSTRACT

A portable door guard used to secure the door at the hinge, particularly the wings of the hinge. The portable door guard comprises a retractable, non-permanently fixed device that can be secured around the hinge of the door from the inside to prohibit the door to open more than a gap. The portable door guard includes a center area designed to grip the hinge to limit the swinging movement of the hinge and adjusting means to configure the size of the gap.

18 Claims, 23 Drawing Sheets

Fig.22
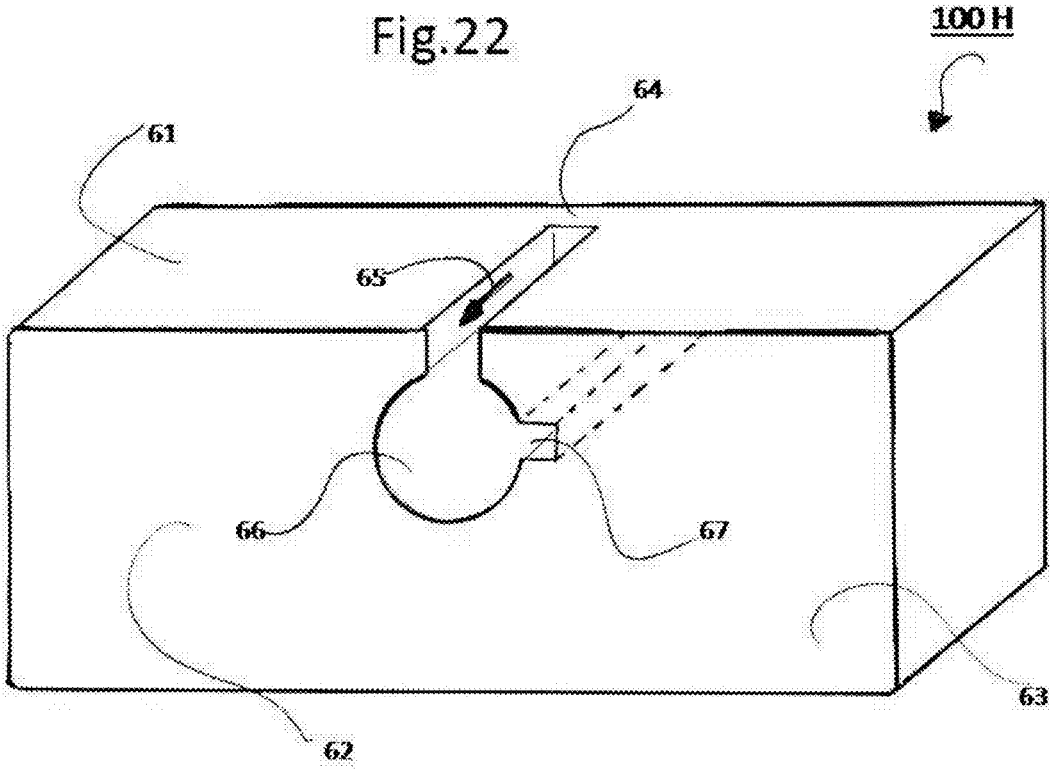
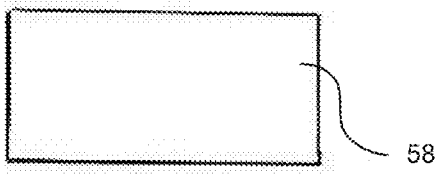
Fig.23
Fig.24
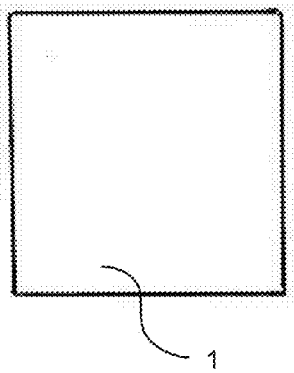

100 J 71
73
101 A
69
72
200 M
68

PORTABLE DOOR GUARD HINGE SECURITY DEVICE

CROSS REFERENCE TO RELATED APPLICATION

This application claims the priority of U.S. Provisional Application No. 61/842,143, entitled "PORTABLE DOOR GUARD HINGE SECURITY DEVICE," filed on Jul. 2, 2013, the disclosure of which is hereby incorporated by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

Field of the Invention

The invention described herein generally relates to a door guard, and in particular, a portable door hinge guard that can be secured on a door hinge from the interior of a door.

Description of the Related Art

Door chains, swing bars, a variety of swing guards, and other types of door guards are widely used as security devices for a door. These door guards allow an occupant to open the door and leave a gap (small opening) to allow the occupant to talk and see or receive objects through the open gap. However, these door guards have their vulnerabilities and can easily be circumvented once the door has been opened either by lock picking or, in the worst case scenario, by an actual key. An intruder, a trespasser or a thief can cut or even force the door guard to spring out of the door and/or the door frame just with a strong push against the door, forcing the screws holding the door guard in place to pop out.

There are many door guards available in the market to increase the security of the door. However, the majority of them are devices that are fixed onto the door and/or onto the complementary elements of the door and not portable or mobile. Most of them, specifically those that are portable, do not offer the feature that allows one to open the door to leave an open gap that is secure enough to allow the occupant to talk and see or receive objects through the open gap just like the chain or swing guards.

Thus, there is a need for a device that maintains the purpose behind the aforementioned door guards, but that can provide an additional buffer that is out of reach from any intruder or trespasser after they have successfully tampered with the security device. Currently, there does not exist a new security device that is not bulky, light, portable, not fixed in place, and that would be able to allow the door to open safely leaving an open gap. Such a device should be versatile enough to be used at home or to be carried along on trips, and to be used as a reusable portable security device for hotels doors, enabling the user not only to depend on the security device for one's own security, but also not having to rely on portable devises that do not offer the option to securely open the door to leave a gap, or to rely on the popular use of a chair pressed against the door to prevent forced entry, or use other commercially available portable devices such as the bulky bar lever that functions under the same principle as the use of the chair.

SUMMARY OF THE INVENTION

The present invention provides a portable door guard apparatus for sliding over a hinge of a door. The portable door guard comprises a body comprising a hollow cylindrical section including an opening gap along the length of the hollow cylindrical section on a stationary section of a back face of the body, wherein the cylindrical section comprises a "C" shaped profile to allow for fitting over a hinge, wherein the hinge comprises a barrel, a first wing, and a second wing, the first wing being mounted on a door frame, and the second wing being mounted onto the door, and the barrel holding the first wing and the second wing together while acting as a pivot. The portable door guard apparatus further comprising at least one movable back face section coupled to a movable center operative to protrude and withdraw relative to the stationary section of the back face and an adjusting means on a front face section of the body for adjusting the protruding and withdrawing of the at least one movable back face section.

According to one embodiment, the body further comprises a left body and a right body adjacent to the hollow cylindrical section. At least one of the left body and the right body includes the movable back face section. The adjusting means may also include a handle. In another embodiment, the portable door guard apparatus includes a base attached to the movable back face section via one or more spring coils. The adjusting means may be configured to distend the one or more spring coils for the protrusion of the at least one of the movable back face section perpendicularly away from the stationary section of the back face. Another embodiment may include the adjusting means protruding through a threaded aperture in the front face section. An inner end of the adjusting means may be in contact with a contact area of a base coupled to the movable center.

In one embodiment, the portable door guard apparatus further comprises a roof on a top end of the body operative as a reinforcement and stopper of the hollow cylindrical section. The portable door guard apparatus may also include a cut out area at a bottom end of the back face of the body to allow the accommodation of a protruding part of a pin of the hinge. The portable door guard apparatus may further include a latch at the bottom end of the back face of the body operative to extend and retract across an open space of the bottom end of the back face.

According to another embodiment, the body further comprises an opening cut out on at least one side along the length of the hollow cylindrical section to allow the sliding of the apparatus from top to bottom without colliding with a protruding part of a pin of the hinge. The portable door guard apparatus is configurable with a barrel augmenter that is provided along a length of the barrel to increase the thickness of the barrel. The barrel augmenter may include an inward edge in one end operative as a stopper of the barrel augmenter. The portable door guard apparatus may also be configurable with a device holder attached to a base support to allow the hollow cylindrical section to slide over the device holder. The device holder may include a plurality of holes for securing the device holder onto a door or a wall.

In another embodiment, the portable door guard comprises a body comprising a hollow cylindrical section including an opening gap along the length of the hollow cylindrical section on a stationary section of a back face of the body, the hollow cylindrical section comprising a "C"

shaped profile capable of fitting over a hinge, wherein the hinge comprises a barrel, a first wing, and a second wing, the first wing being mounted on a door frame, and the second wing being mounted onto the door, and the barrel holding the first wing and the second wing together while acting as a pivot and at least one body section configured to impede the door from opening more than a given amount, the at least one body section capable of being extended, expanded and/or shortened or reduced.

According to a further embodiment the at least one body section comprises at least one back side cut out section to accommodate a protruding door frame molding or fixture. The at least one body section is configurable with a support section filler part. The support section filler part is configured to compensate for the at least one back side cut out section. In one embodiment, the portable door guard apparatus comprises a rounded front face, a left body side and a right body side wherein the left body side and the right body side includes rounded shaped grooves.

BRIEF DESCRIPTION OF THE DRAWINGS

The invention is illustrated in the figures of the accompanying drawings which are meant to be exemplary and not limiting, in which like references are intended to refer to like or corresponding parts, and in which:

FIG. 22 illustrates a perspective bottom view of a further embodiment of the security device;

FIG. 23 illustrates a top view of the security device according to an embodiment of the present invention;

FIG. 24 illustrates a front view of the security device according to an embodiment of the present invention;

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part.

The security device described according to embodiments of the present invention achieves the same purpose as conventional door guards without their vulnerabilities as discussed above. It also allows the door to be opened just enough to allow the occupant to talk and see or receive objects through the small opening when the door is open ajar. Focus is centered particularly on the wings of the hinge, an area that has not been explored as much. The security device according to embodiments of the present invention would hover particularly around the wings of the door hinge from the interior of a room and would be out of reach from the intruders outside. The security device may be a reusable, retractable, non-permanent and portable gripping device that can be secured and easily released around the hinge of the door from the inside and will allow the door to open leaving a gap.

The device includes a center area designed to firmly grip the door hinge to serve as the backbone support to hold the device in place. At the same time, once firmly gripped in place, the device limits the swinging movement of the hinge, and the entire body of the device is made to withstand the force exerted by the door when it is opened. The essential purpose of the device is to protect the occupant by not allowing the door from opening more than what is permitted by the security device.

Figure 1:
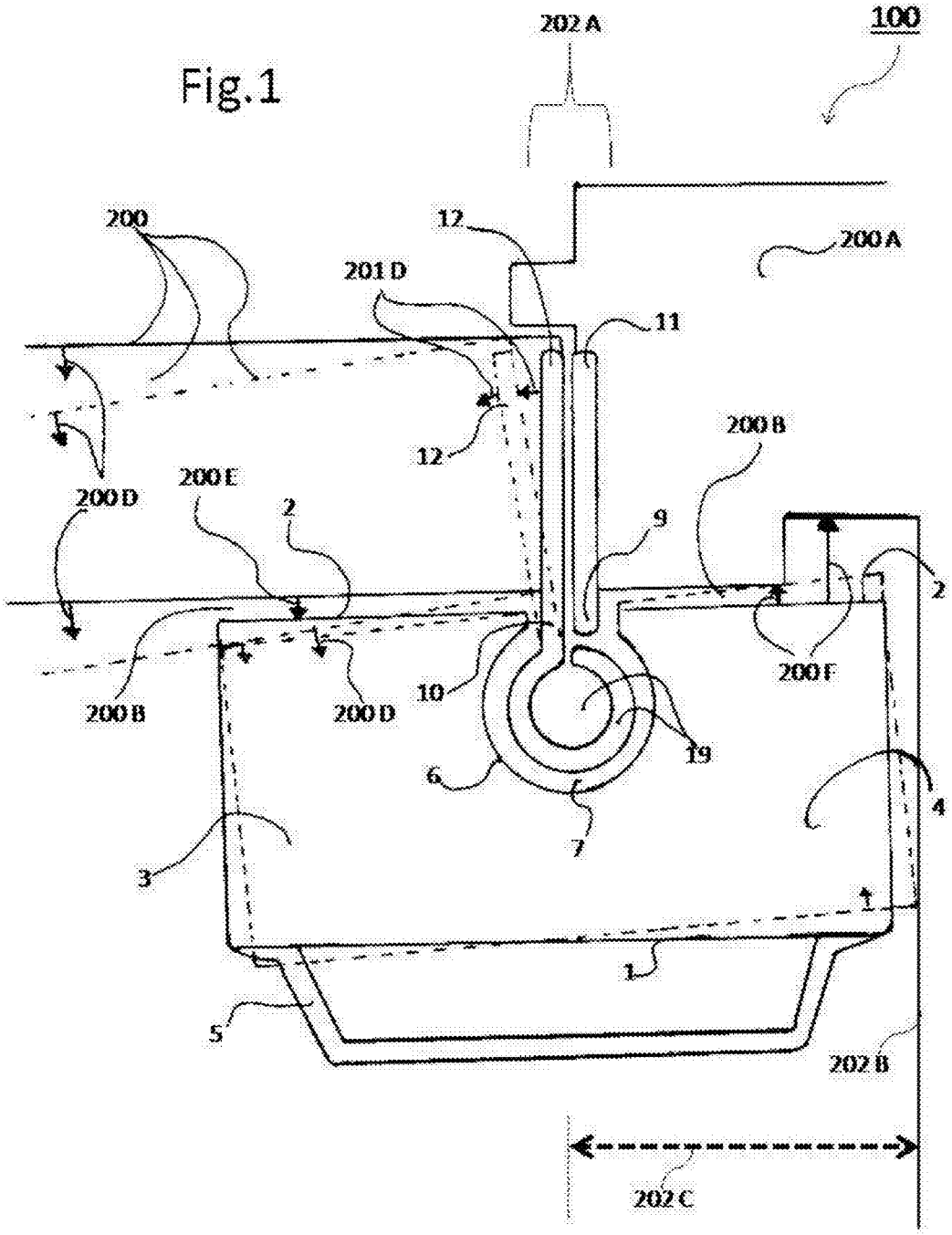
FIG. 1 illustrates a top view of the security device showing a cross-sectional view without the top for illustrational purposes according to an embodiment of the present invention.
Figure 2:
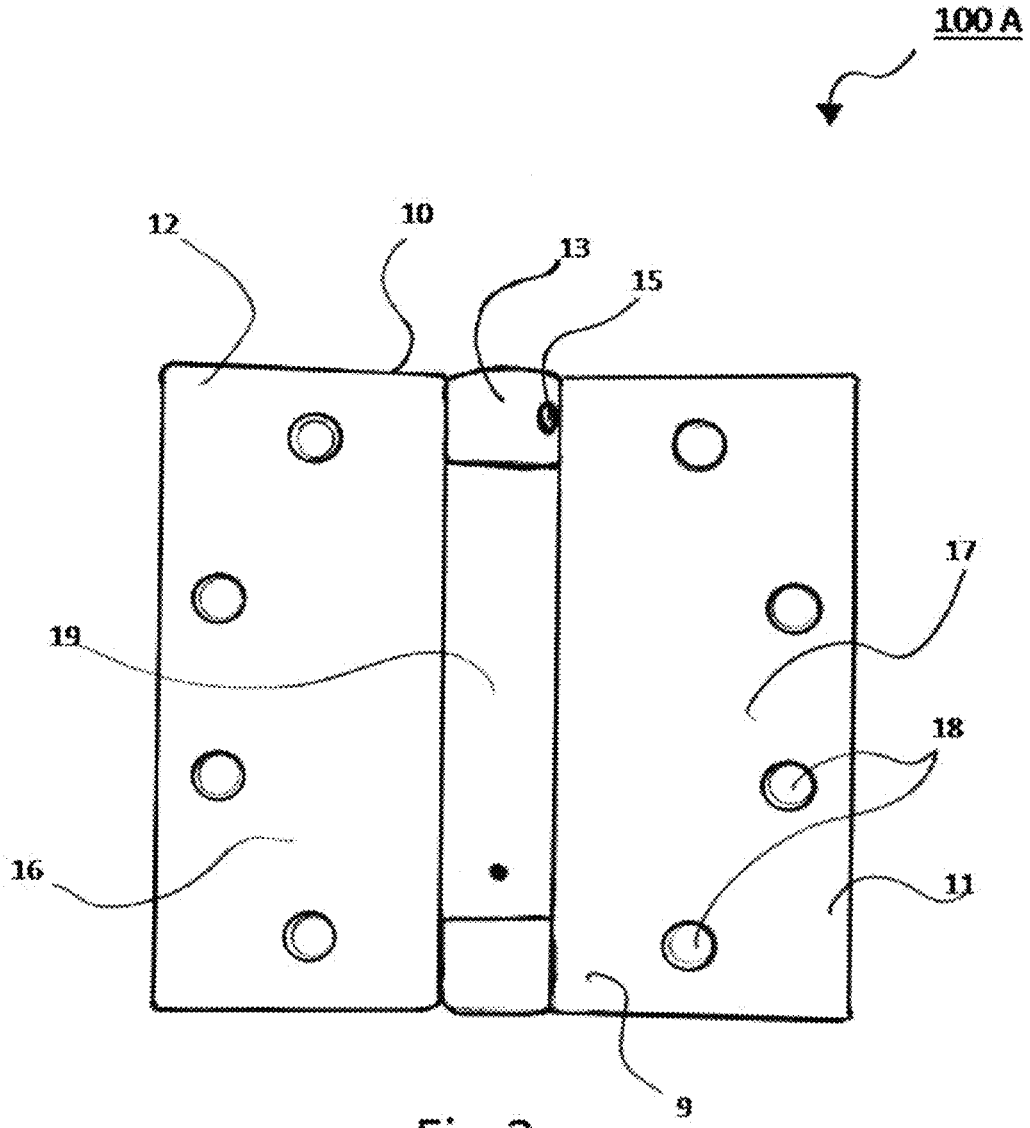
FIG. 2 illustrates a front view of a related element of the security device according to an embodiment of the present invention.

FIG. 1 presents security device 100 that is secured to door 200 about the hinge 100 A, particularly on wings 16 and 17. Hinge 100 A may be any of one or more hinges installed on door 200 and door frame 200 A. Referring to FIG. 2, a hinge 100 A in FIG. 2 comprises barrel 19 (pivot point), two sections besides the barrel referred to as wings 16 and 17-frame wing 17 and the other side, door wing 16. The frame wing 17 is mounted on the door frame 200 A, while the door wing 16 is mounted onto the door 200, and the barrel 19 holds the two wings 16 and 17 together while acting as a pivot in the performance of its function.

Figure 3:
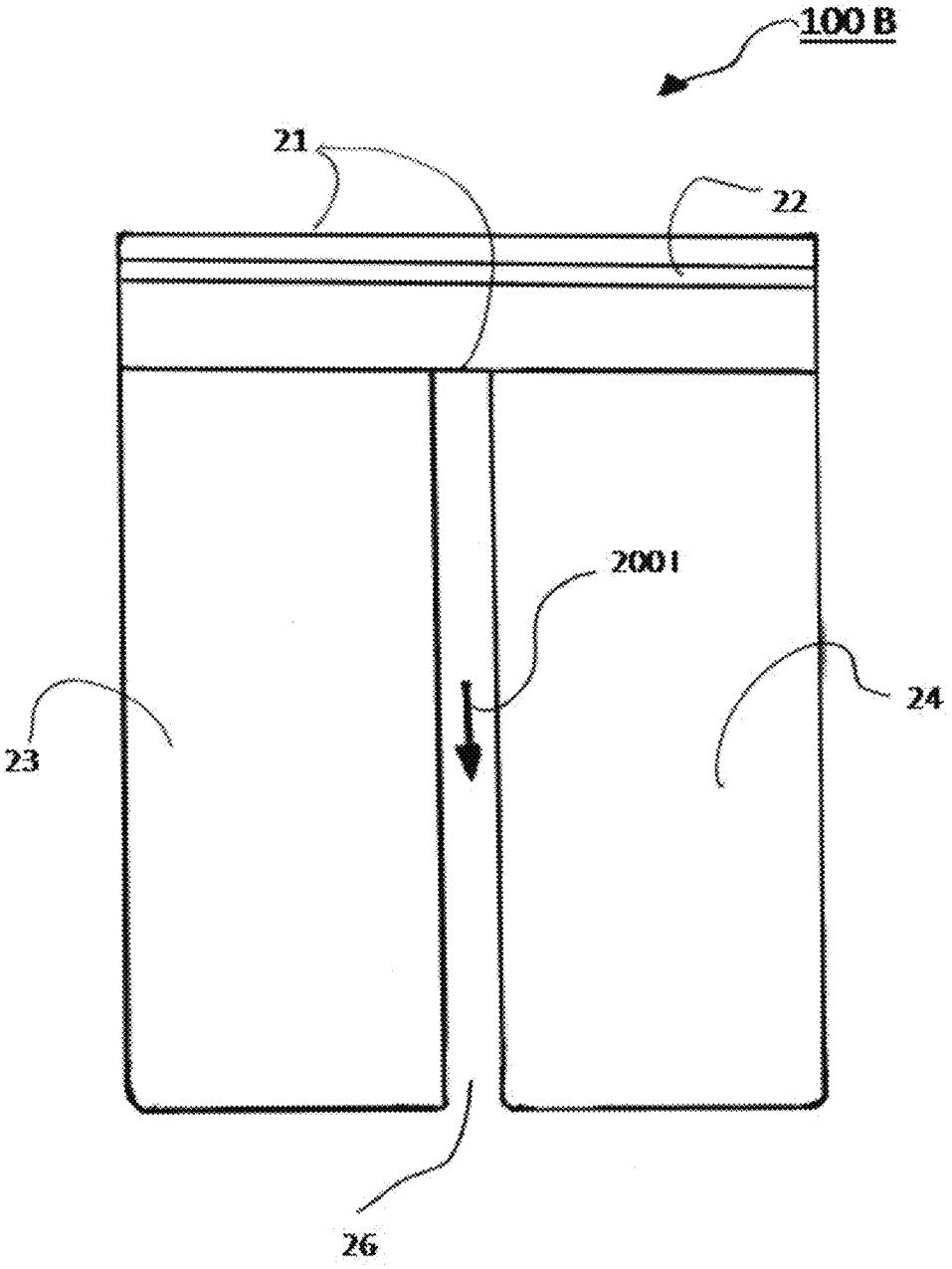
FIG. 3 illustrates a front view of a further embodiment of the present invention.
Figures 5, 6, 7:
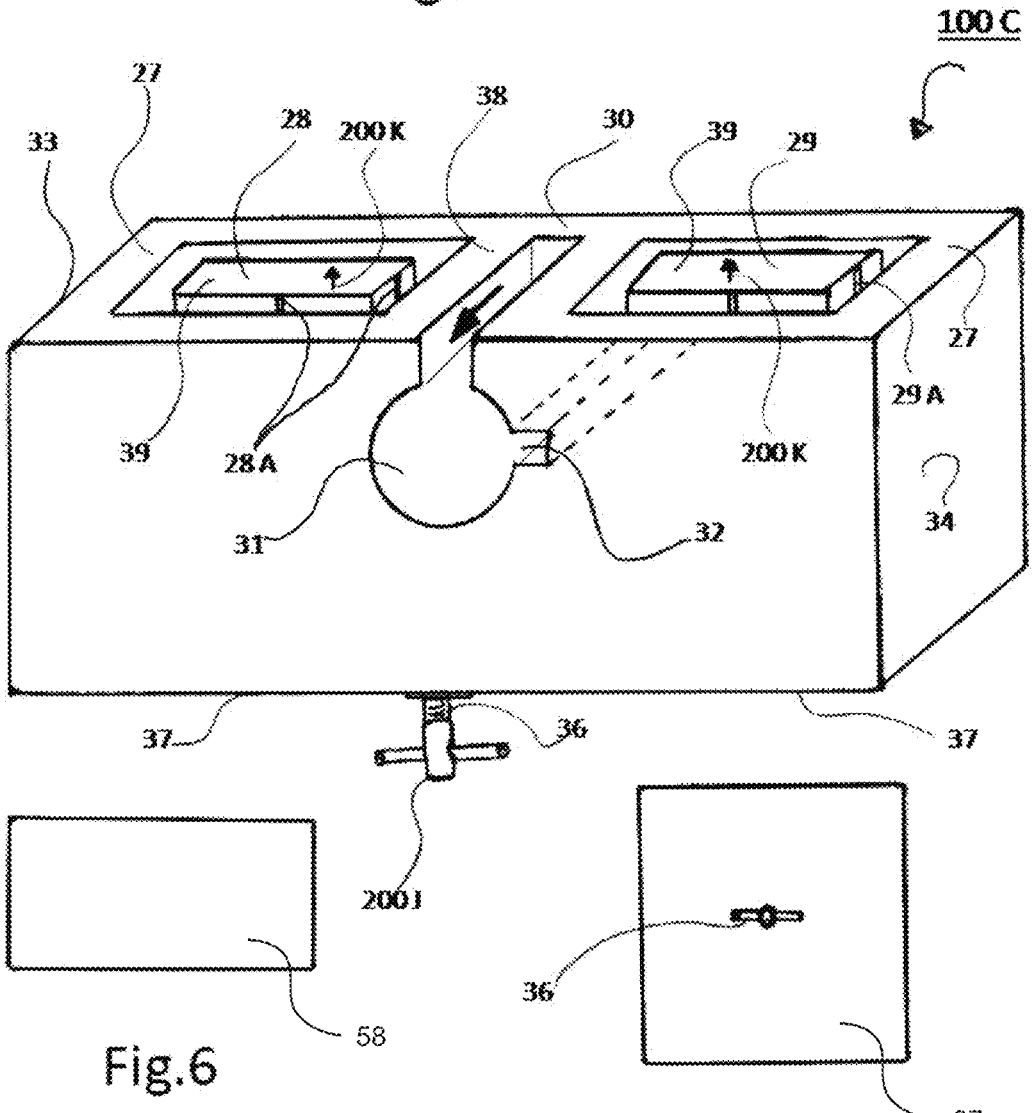
FIG. 5 illustrates a perspective bottom view of an alternative configuration of the security device according to an embodiment of the present invention.
FIG. 6 illustrates a top view of the security device according to an embodiment of the present invention.
FIG. 7 illustrates a front view of the security device according to an embodiment of the present invention.

The security device 100 comprises a block, a half-cylinder, a semi-elliptical block, or any other appropriate practical form, made of strong plastic, metal, metal alloy, wood, or any other suitable material or combination of materials, that has a hollow cut-out cylinder area 6 with an opening gap along the whole length of the cylinder, wide enough to accommodate the two wings 16 and 17 close together to each other. The cylinder area 6 is shaped in a hollow "C" fashion that is located approximately in the center of the back face 2 of the security device 100 to allow gripping and fitting over the barrel 19 and the door wing proximal end 10 section and the frame wing proximal end 9 section. The security device also includes a cover area at the top face called the roof 21 as shown in FIG. 3, and roof 30 in FIG. 5, with the roof not shown in FIG. 1, as it is cut out to demonstrate for illustration purposes the upper section of the security device 100. The roof acts as reinforcement and stopper of the device. On top of the frontal face 1, or on any other suitable place of the security device, there is an optional semicircular, semielliptical or any other shaped bar 5 that serves as a reinforcement of the two opposite distal sections or portions of the body, the distal door side 3 section of the body, and the distal door frame side 4 section of the body. The bar 5 may also act as a handle or a pull to maneuver the security device 100. An alternate design mirroring the handle or pull could also be incorporated.

The security device 100 provides gripping closer together the two proximal end 9 and 10 (the part adjacent to the barrel) sections of the wings 16 and 17, and the barrel 19 of the hinge 100 A. The gripping limits the amount of movement when the door is opened 200 D and the limits the degree or swing of the opening during the swinging 201 D movement of the distal end 12 section of the door wing, while the distal end 11 section of the frame wing remains stationary. The gripping force is capable of securing together the two wings 16 and 17, particularly the proximal end 9 and 10 sections closer to each other, while at the same time gripping the barrel 19. As a result, the closer the wing 11 and 12 sections are to each other, the lesser the opening of the door gap. Once the security device 100 is firmly gripped to the hinge 100 A, it will serve as the backbone support to hold the security device 100 in place with the entire body. Specifically, sections 3 and 4 of the security device 100 are elements operable to withstand the force of the pressure exerted on the security device 100 when the door 200 opens 200 D inwardly. The device prohibits the door 200 to be opened 200 D more than allowed by security device 100.

The security device 100 may be constructed in such a way that once it slides onto the hinge 100 A, the two opposing distal 3 and 4 sections or portions of the body of the security device 100 act as support to withstand the pressure of the force 200 E and 200 F exerted by the door 200 opening inwardly 200 D against the contacts between the back face 2 of the security device 100, the door 200 and the door frame 200 A. It would only allow the door 200 to open 200 D inwardly up to the amount permitted by the security device 100. The pressure 200 E is the force exerted by the door 200 opening 200 D against the back face 2 of the body 3 sections of the security device 100, and the pressure 200 F is the force exerted by the back face 2 of the body 4 sections of the security device 100 against the door frame 200 A. The security device 100 also acts as a levering counter force between the door 200 and the door frame 200 A by utilizing the barrel 19 as a fulcrum and as an epicenter to secure and support. Security device 100 also limits the movement of the wings 16 and 17, particularly the sections 9, 10, 11 and 12 of the wings and the door 200. Other alternate devices could be made, by extending or shortening the length and/or size of one or both of the body 3 and 4 sections of the security device 100. That is, the longer and thicker the body 3 and 4 sections are, the firmer and stronger are the supports for impeding the door 200 from opening 200 D more than the amount permitted according to by the security device 100, which may be configurable according to other embodiments.

Figure 1A:
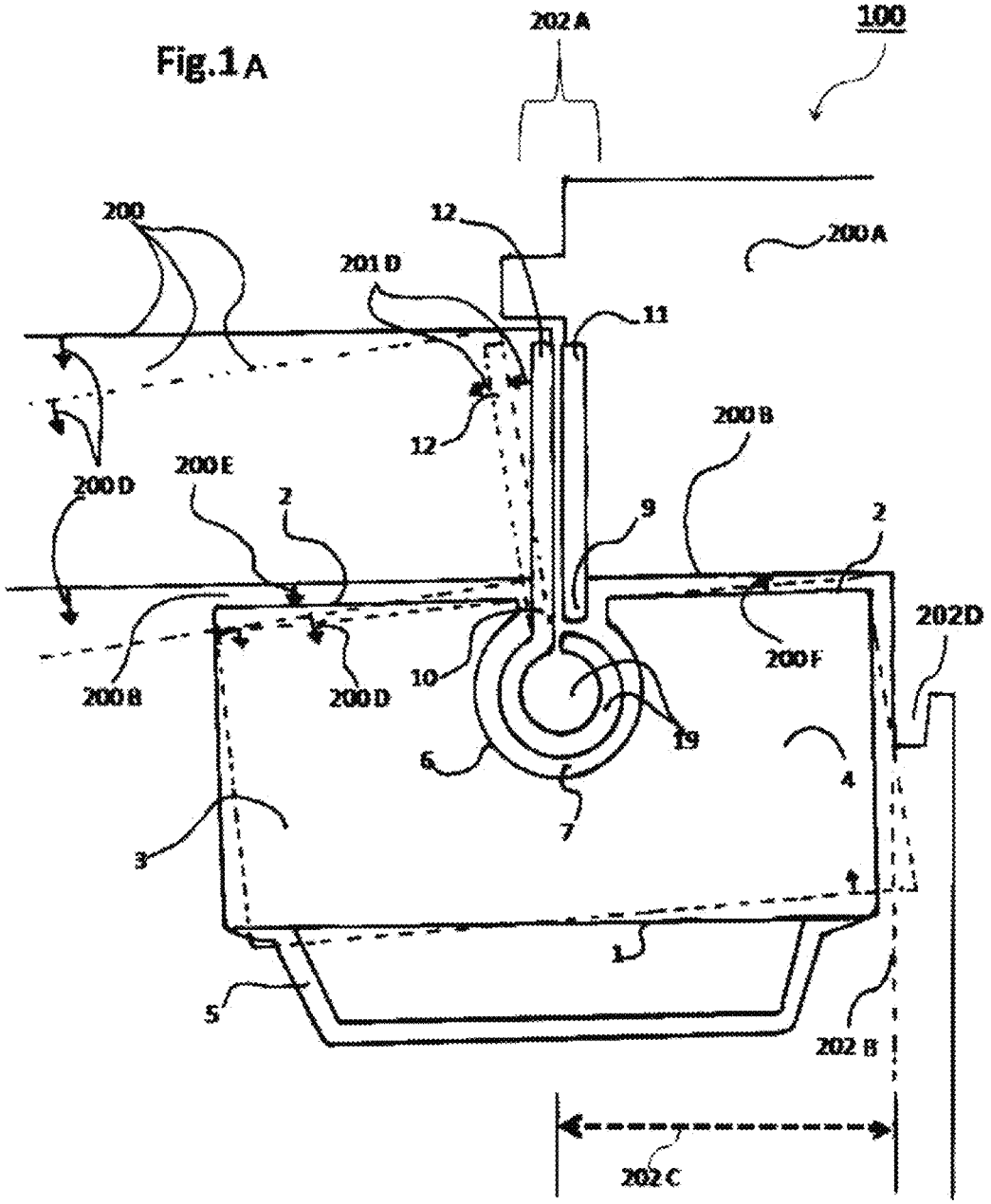
FIG. 1A illustrates a top view of the security device showing a cross-sectional view without the top for illustrational purposes according to an embodiment of the present invention.

Due to the inconvenience of carrying bulky devices, and the variable placement of the opening swing side of hotel doors, the most practical size of the security device 100 for travel as a portable device is made with a standard (as described) similar small-sized body 3 and 4 sections. However, the security device 100 for e.g., home usage, can be made in several different versions, depending on the distance 202 C, which is the distance between the hinge side door frame 202 A, and the closest adjacent perpendicular wall 202 B in FIG. 1, or a protruding door frame molding or fixture in 202 D performing as a perpendicular wall in FIG. 1A. The further the adjacent perpendicular wall 202 B is away from the hinge side door frame 202 A, the longer (larger) the distal door frame side 4 section of the body could be made, which would result in a stronger support base for the security device 100. In other words, the length (size) of the distal door frame side 4 section of the body is dictated by the distance 202 C. While in the distal door side 3 section of the body, it could always be made reasonably longer enough to provide a firmer and stronger support as there is no distance 202 C restriction for a longer sized distal door side 3 section of the body. The body configuration of the security device 100 described above could be used more appropriately for a home environment, as the user would know the geographical location of the hinge side door frame 202 A in relation to the nearest adjacent perpendicular wall 202 B.

In the situation where the space separation 200 B between the face with the hollow "C" area 6 in the back face 2 of the security device 100, the door 200 and the door frame 200 A is greater than the desired amount, that is, an amount that allows the door 200 to open 200 D more than the desirable gap, an optional complementary device 100 B may be provided as presented in FIG. 3. The complementary device 100 B includes a roof 21 section big enough to serve as a handle 22 and as a reinforcement, with a sufficiently cut out space 26 approximately in the center area of the complementary device 100 B. The space 26 serves to grip together the two wings' proximal end 9 and 10 sections, and for it to slide 2001 over the two proximal end 9 and 10 sections of the wings 16 and 17. Complementary device 100B also includes two body parts, the right body 23 part and the left body 24 part with sufficient size, width and depth as to adequately fill the excess space 200 B between the back face 2 of the security device 100, the door 200 and the door frame 200 A. The optional complementary device 100 B in FIG. 3 has a double function—first by limiting the space 200 B as described above, and second by offering an extra gripping force in securing together the two wings 16 and 17, particularly the two proximal end 9 and 10 sections close together, and to a lesser extent, the distal end 11 and 12 sections.

Figure 4:
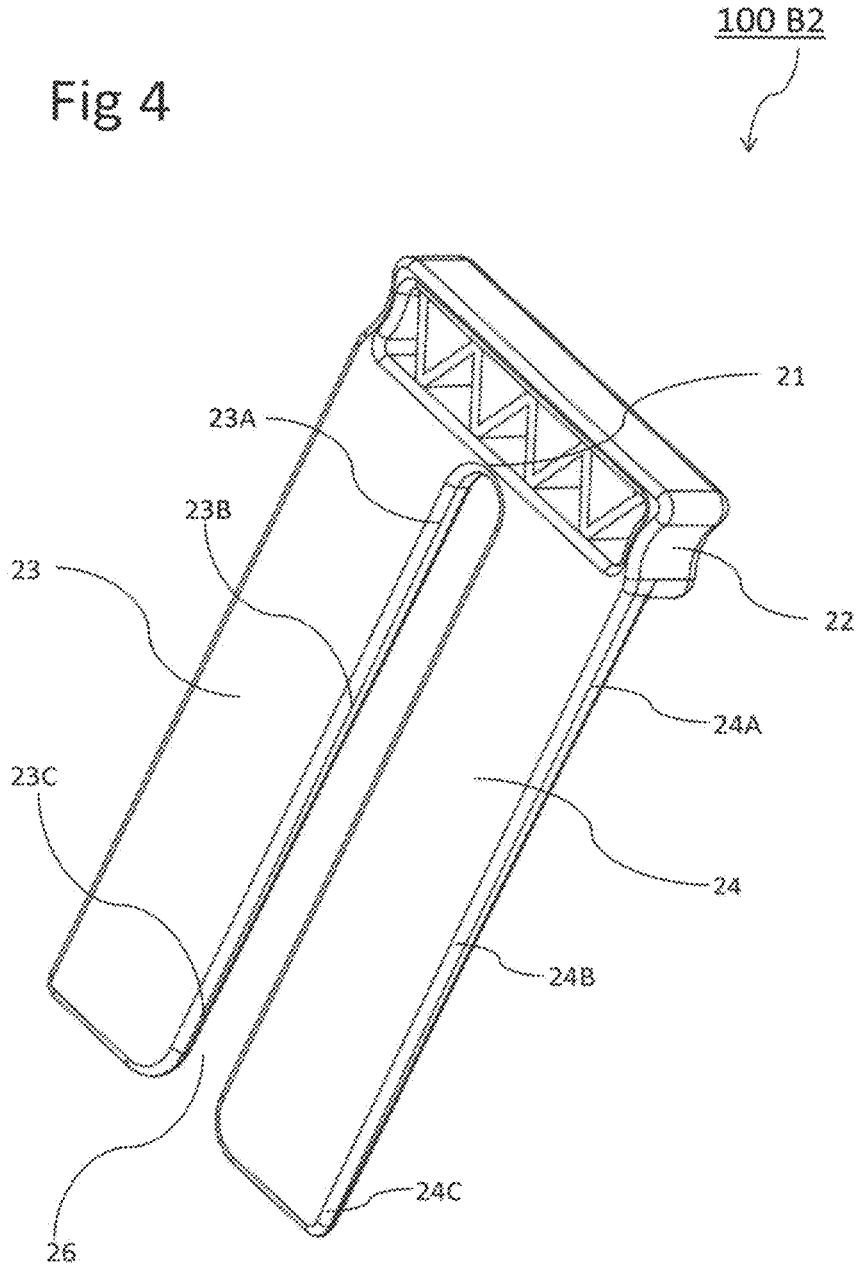
FIG. 4 illustrates a perspective view of another different design of a further embodiment to the present invention.

FIG. 4 presents an optional complementary device 100 B2 according to another embodiment; the device is capable of performing all the functions of device 100 B including situations that involve different degrees of separation or spacing between the door and the device 100. The device 100 B2 may be configured to act also as a universal space compensator as it varies in thickness along both the right body part 23 and the left body part 24. The thickness in the body parts are in a degrading manner, reducing in thickness from the top downwards, the thickest being 24A and 23A in FIG. 4, down to the middle parts 24B and 23B of mid-size thickness, then down to the thinnest part 24C and 23C in the bottom of the device 100 B2. Alternate mechanisms to achieve the same function as described above are achieved by incorporating the features of the complementary device 100 B in FIG. 3 and device 100 B2 in FIG. 4 onto the main security device 100.

Figures 8, 9, 10, 11:
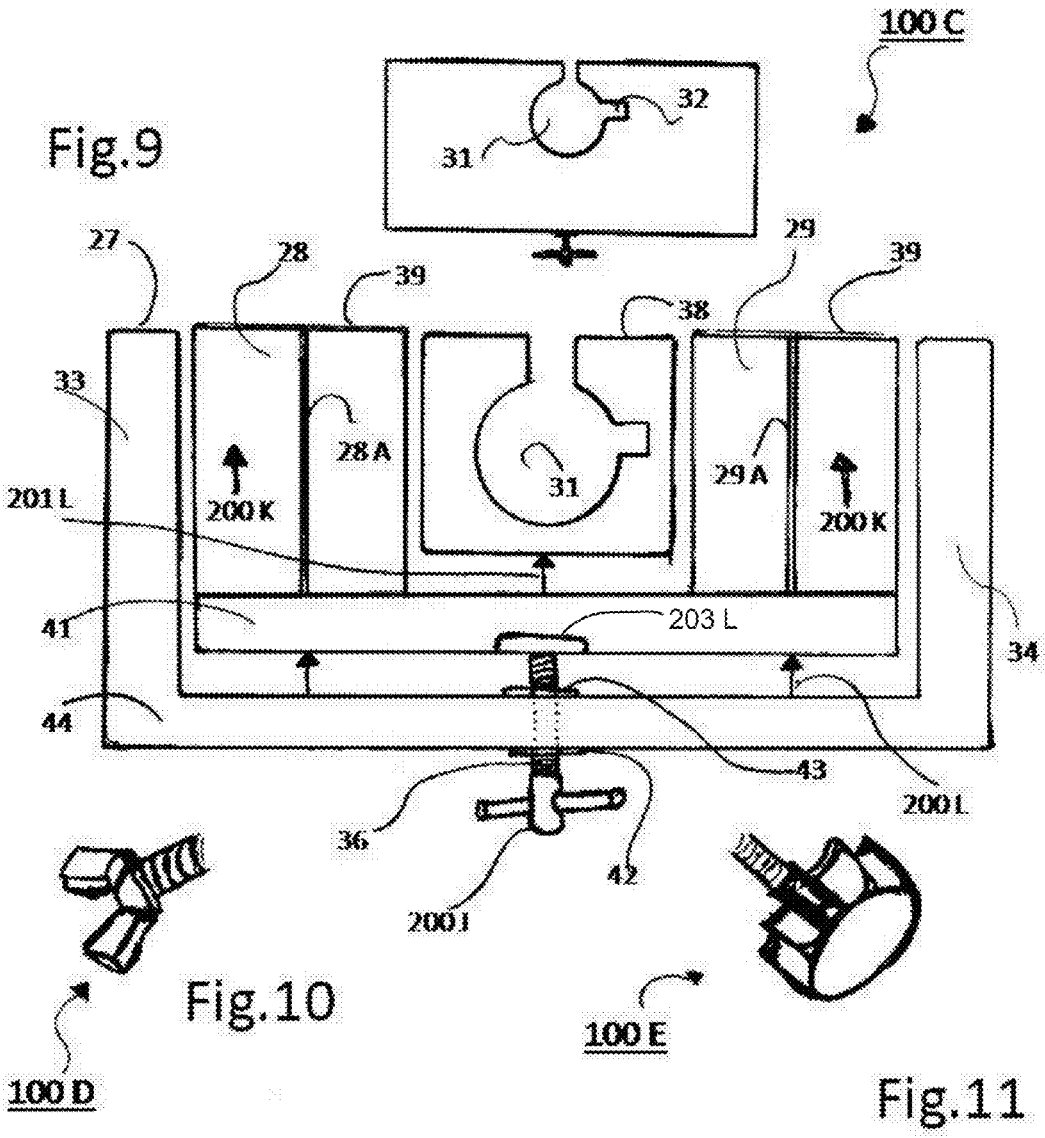
FIG. 8 illustrates a bottom view of the security device according to an embodiment of the present invention.
FIG. 9 illustrates a top view of the security device showing a cross-sectional view without the top for illustrational purposes in accordance with an embodiment of the present invention.
FIG. 10 illustrates a perspective view of a different design of the handle according to an embodiment of the present invention.
FIG. 11 illustrates a perspective view of another different design of the handle according to an embodiment of the present invention.
Figure 12:
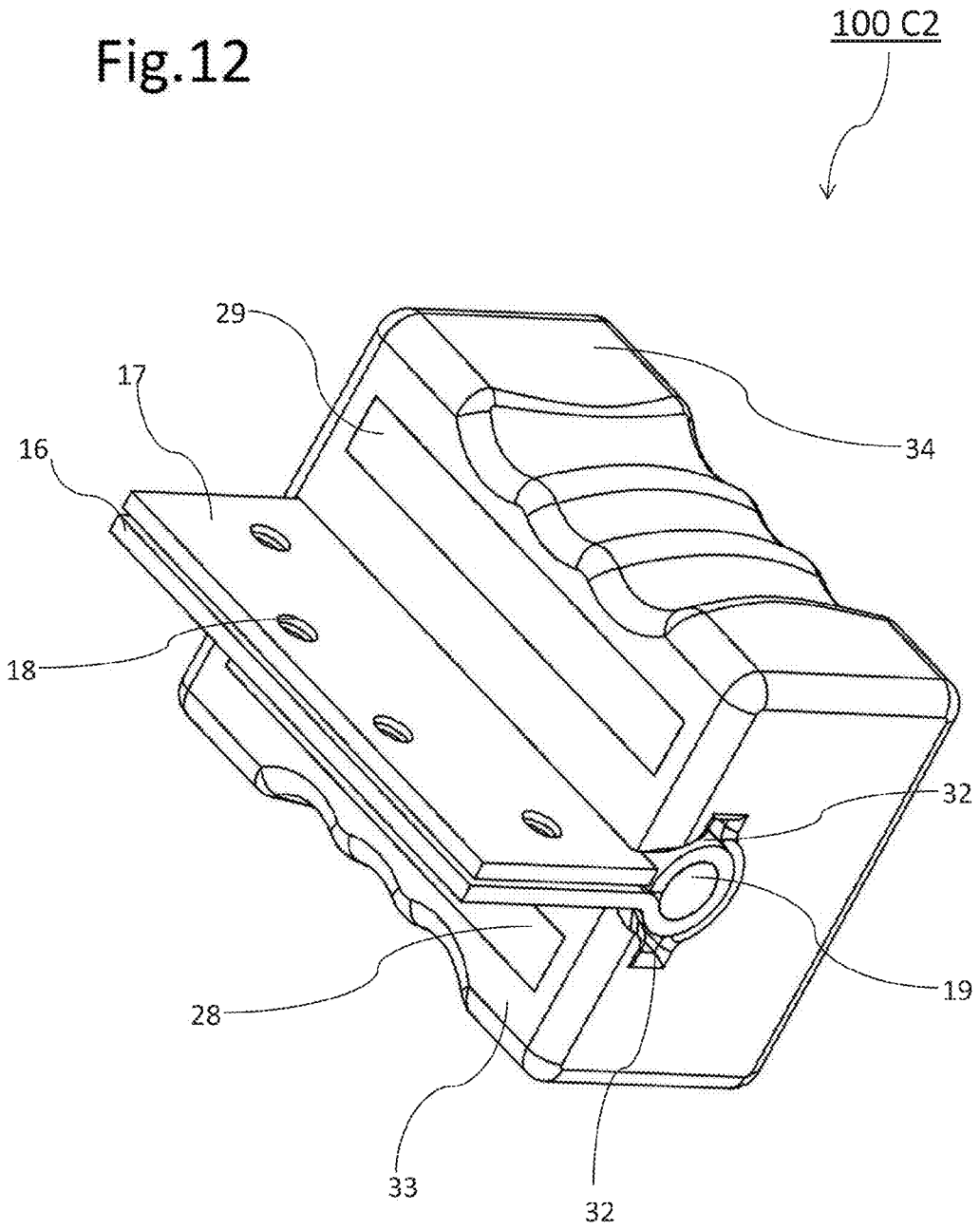
FIG. 12 illustrates a perspective view of another different design of the security device according to an embodiment of the present invention.
Figure 13:
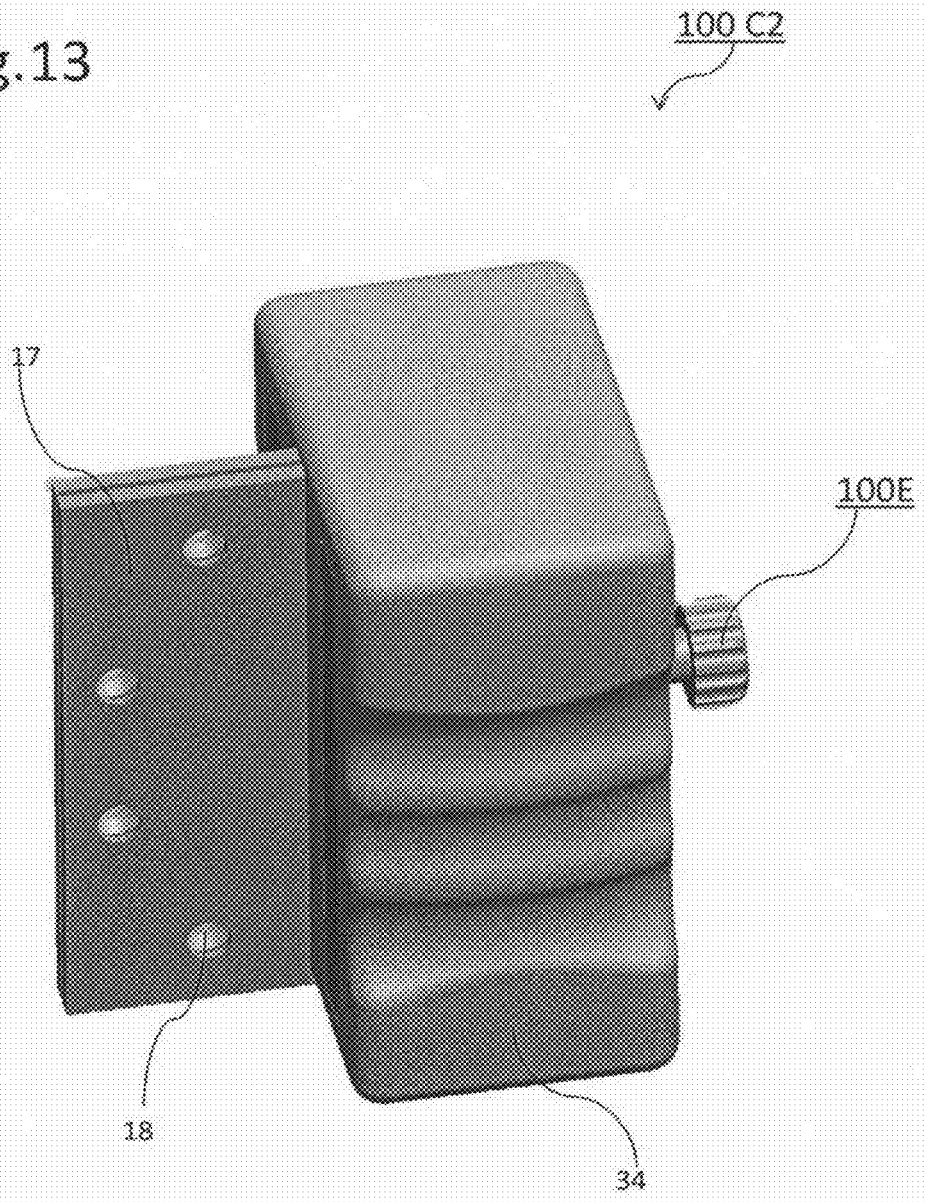
FIG. 13 illustrates a perspective view of another different design of the security device according to an embodiment of the present invention.
Figures 14, 15, 16, 17:
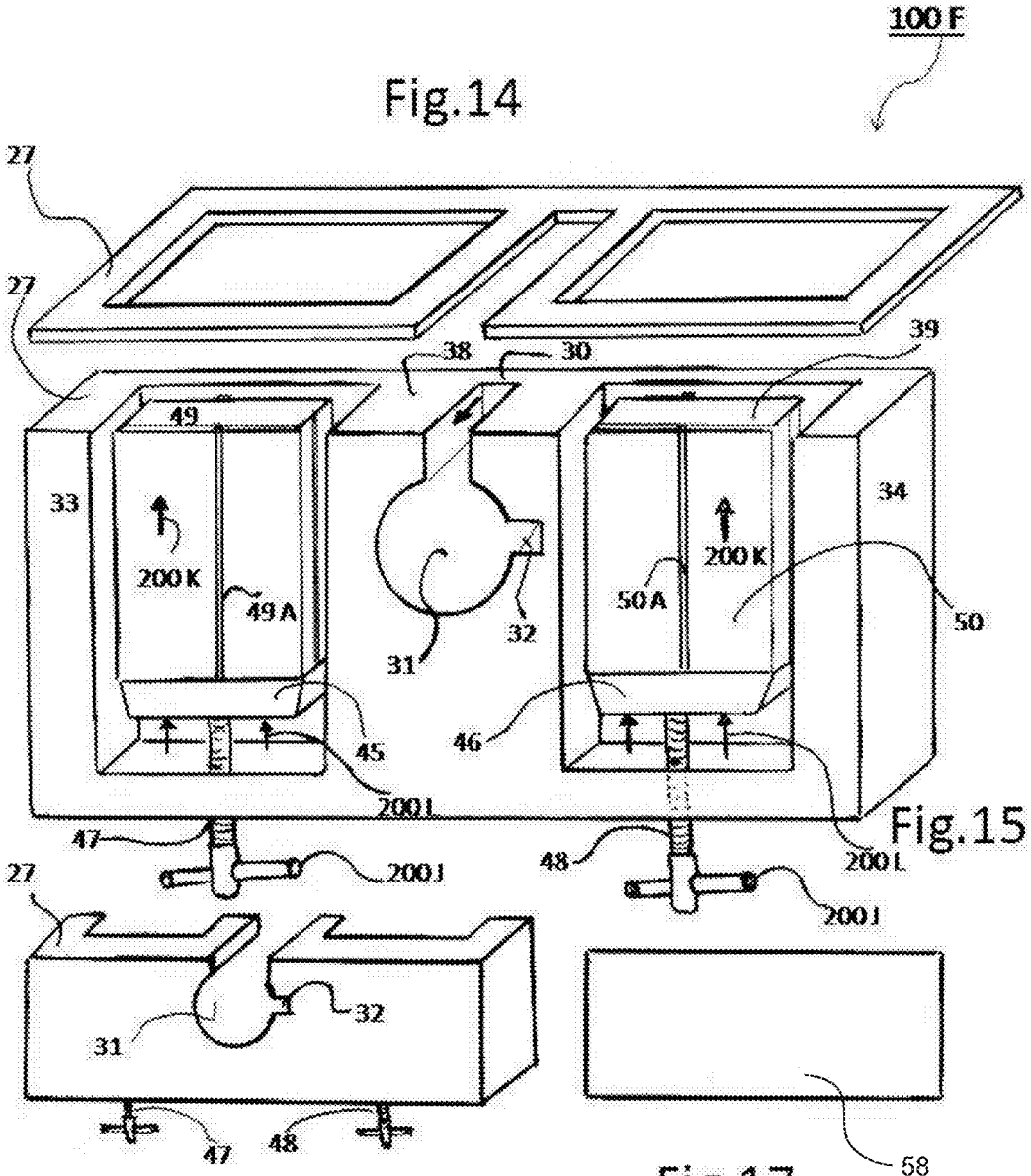
FIG. 14 illustrates a perspective back section cross-sectional view of the security device according to an embodiment of the present invention.
FIG. 15 illustrates a perspective bottom cross-sectional view of the security device according to an embodiment of the present invention.
FIG. 16 illustrates a perspective bottom view of the security device according to an embodiment of the present invention.
FIG. 17 illustrates a top view of the security device according to an embodiment of the present invention.
Figures 18, 19, 20, 21:
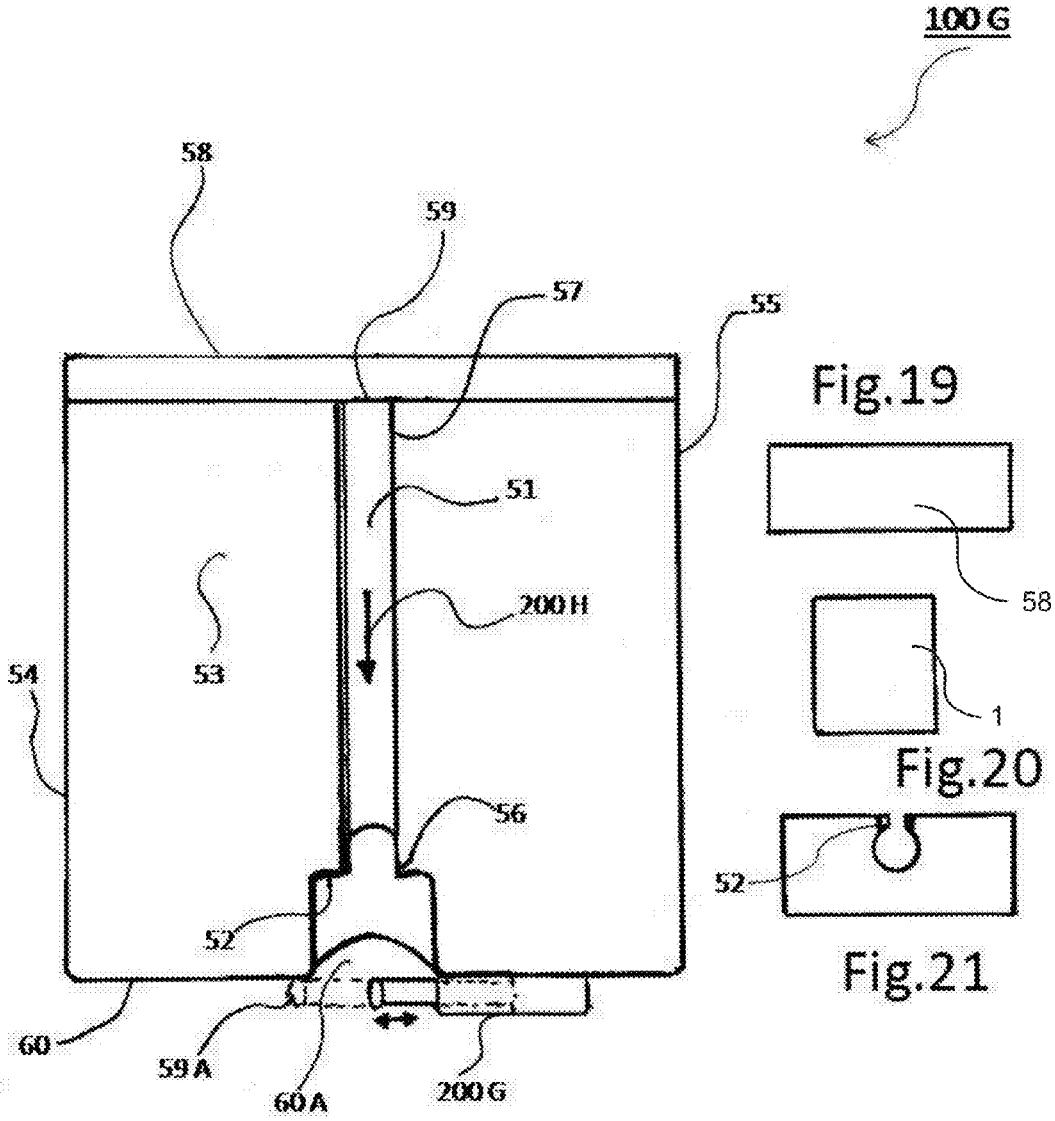
FIG. 18 illustrates a back view of an alternative embodiment of the present invention.
FIG. 19 illustrates a top view of the security device according to an embodiment of the present invention.
FIG. 20 illustrates a front view of the security device according to an embodiment of the present invention.
FIG. 21 illustrates a bottom view of the security device according to an embodiment of the present invention.
Figure 25:
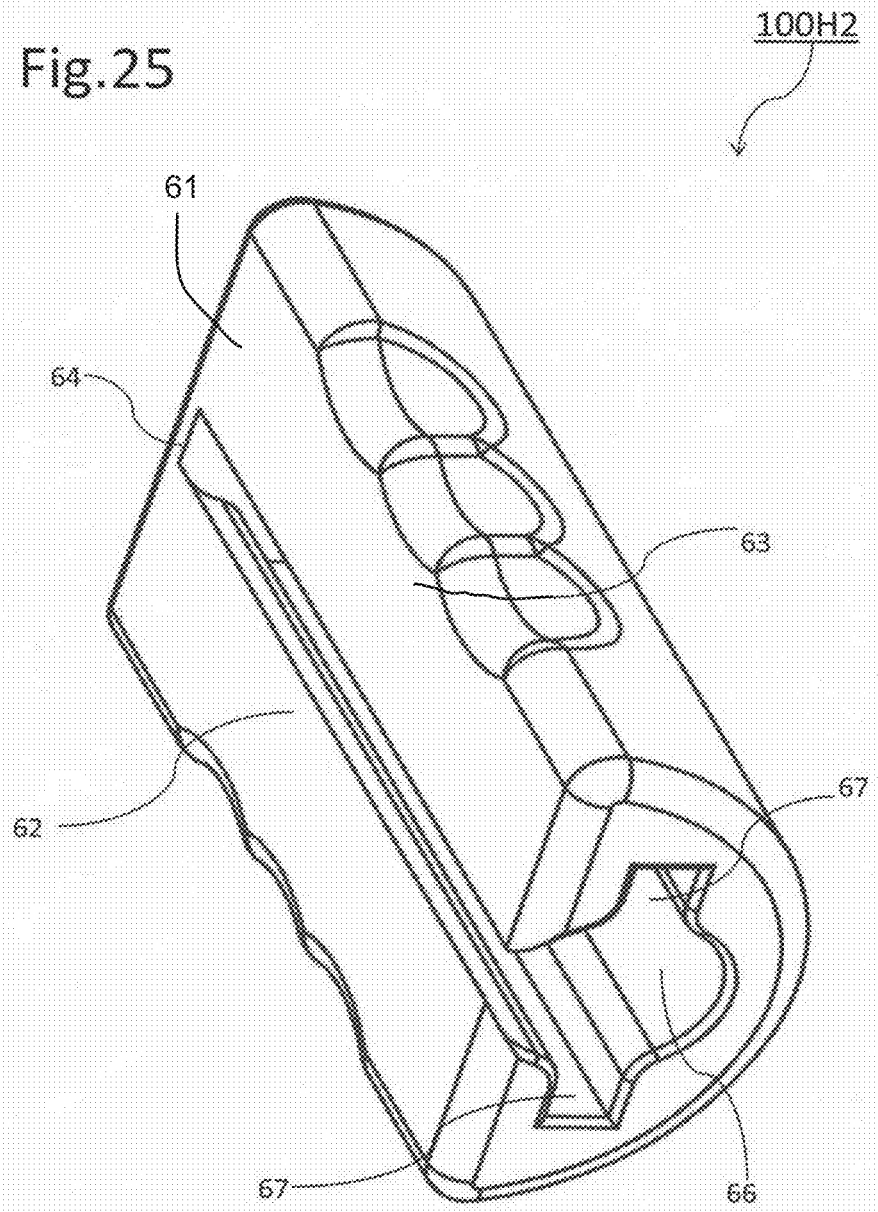
FIG. 25 illustrates a perspective view of the security device according to another embodiment of the present invention.
Figure 26:
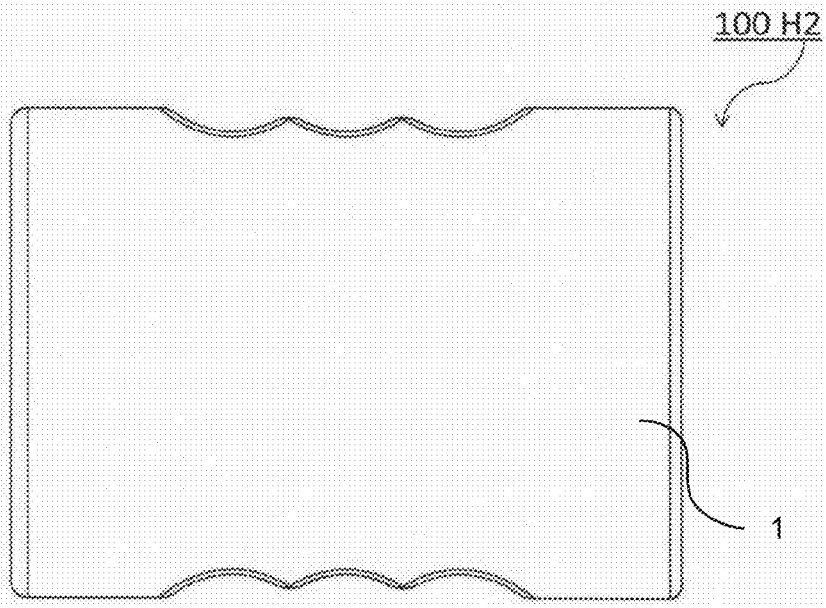
FIG. 26 illustrates a front view of another embodiment of the present invention.
Figure 27:
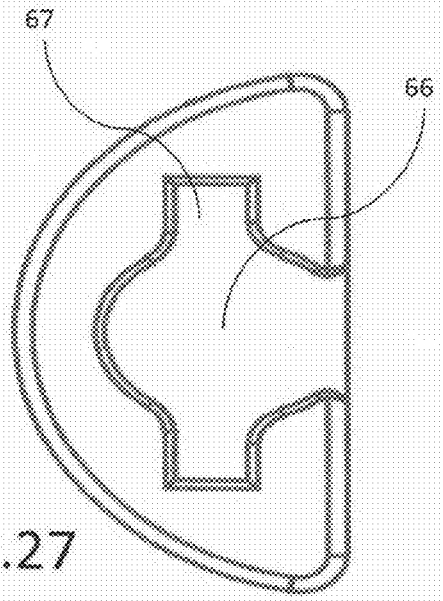
FIG. 27 illustrates a bottom view of another embodiment of the present invention.
Figure 28:
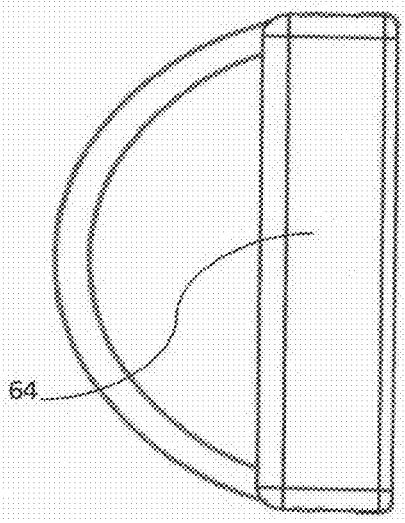
FIG. 28 illustrates a top view of another embodiment of the present invention.
Figure 29:
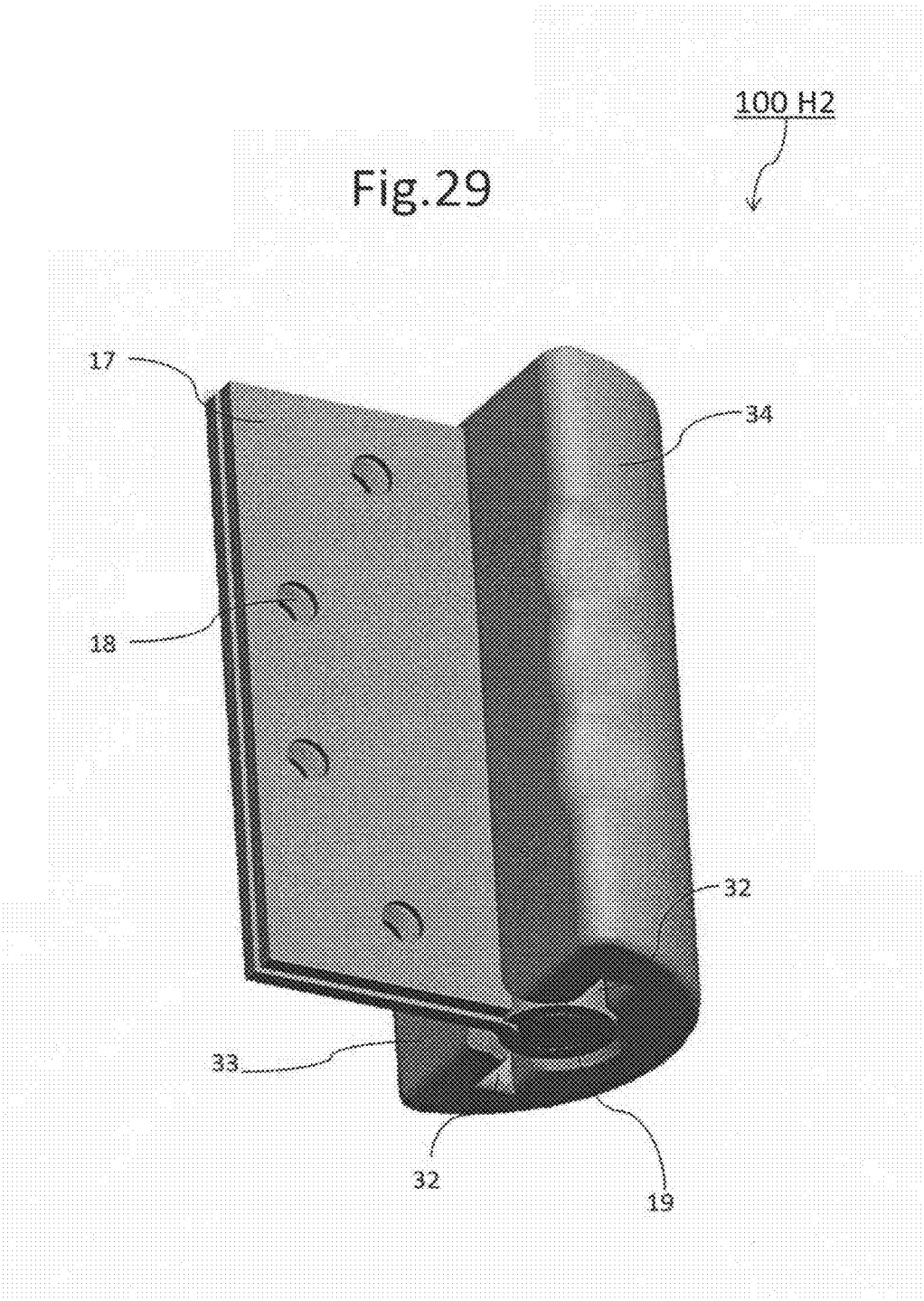
FIG. 29 illustrates a perspective view of another embodiment of the present invention.

FIG. 5 through FIG. 11 presents a device 100 C including two jointly movable centers that could be shaped, for example, as a square body, a rectangular body, a cylindrical body or a multifaceted body (this multiple variety of different faceted bodies are not shown). The two jointly movable centers are comprised of a left movable center area 29 or "LMCA" 29 and a right movable center area 28 or "RMCA" 28. The movable center areas are each located in one of the two back side sections of the body—the back left side body 34 section or "BLB" 34 and the back right side body 33 section or "BRB" 33. They are separated externally by the back face section 27, and internally by the hollow "C" 31 area in the non-movable back face 38 section of the device 100 C. These two jointly movable center areas, LMCA 29 and RMCA 28, are armed with sliding rails 28 A and 29 A, or any other surface that allows easy sliding, in each of its contact sliding faces, except in the case of a cylinder in which case it will be adequately placed (not shown). LMCA 29 and RMCA 28 are adjustable for protrusion from their respective recesses on back face section 27 (BLB 34 and BRB 33) via an adjusting screw 36. Both LMCA 29 and RMCA 28 have a movable back face 39 section, and both are placed and attached in such a way that when using any distending (stretching out) mechanism such as the method of screwing inwardly using adjusting screw 36, as shown in FIG. 9, the support 41 (base) that is attached to an adjusting screw 36 and one or more spring coils 200 L, which serves to maintain the support 41 retracted in place. This distending mechanism is capable of distending 201 L, and the moving forward 200 K of the two jointly movable center areas, LMCA 29 and RMCA 28, perpendicularly away from the non-movable front face 44 or 37 section of the security device 100 C.

The non-movable front face 44 section of the security device 100 C in FIG. 9 includes a threaded aperture with an external orifice 42, and an internal orifice 43 through which a threaded screw (adjusting screw 36) protrudes. The inner end of the adjusting screw 36 is in contact with a reinforced contact 203 L area of an adequately sized base 41 (support), which is attached to one or more spring coils 200 L, or adjustable screws that perform in like manner. The spring coil(s) 200 L may be attached into any appropriate location in conjunction with support 41. At the same time, the spring coil(s) 200 L are attached onto the corresponding mirrored location on the non-movable front face section 44. The spring coil 200 L serves to maintain the support 41 retracted in place, and the support 41 is also attached to the two jointly movable center 28 and 29 areas or LMCA 29 and RMCA 28 of the BLB 34 and BRB 33 sections. The outer other end of the adjusting screw 36 includes a small metal bar 200 J (as illustrated), or any other differently shaped handle such as 100 D in FIG. 10 or 100 E in FIG. 11. The small metal bar 200 J is perpendicular to the adjusting screw 36 itself, which is used to gain leverage when tightening the adjusting screw 36 to distend the base 41 (support), which at the same time distends the two spring coils 200 L. Tightening of the adjusting screw 36 is capable of moving the two jointly movable center 28 and 29 areas or LMCA 29 and RMCA 28 of the BLB 34 and the BRB 33 sections closer against the door 200 and the door frame 200 A, reducing the space separation 200 B between the back movable face 39 of the security device 100 C, the door 200 and the door frame 200 A. Thus the space separation 200 B is adjustable to limit the amount of door swing when the door is opened with security device 100 C mounted on a hinge.

In an alternative embodiment, device 100 F is presented in FIG. 14 to FIG. 17 where two threaded apertures are used and complemented with two adjusting screws, the right adjusting screw 47 and the left adjusting screw 48 in FIG.

15. Each one of the two adjusting screws 47 and 48 are in contact with a separate base 45 and 46 (support), and each one of the bases 45 and 46 are attached separately to spring coils 200 L (or similar means). Each one of the bases 45 and 46 are attached separately to each one of the two independent movable center areas 49 and 50, one attached to the LMCA 50 and the other to the RMCA 49. Both movable center areas 49 and 50 are designed to slide on rails 49 A and 50 A, respectively. The other elements of the device 100 C, the device 100 C2 and the device 100 F in FIG. 5 to FIG. 17 of comparative functions as well as their working mechanisms are substantially similar to device 100 as described above. Alternate designs and mechanisms that lead to the same results could be employed to achieve the reduction of the space separation 200 B between the different security devices 100, the door 200 and the door frame 200 A without departing from the principle of the security device 100.

The various embodiments of security devices 100 may be constructed to accommodate various hinge shapes and designs. Two (2) commercially popular hinge models used in today's market for hotel room entrances and for principal entrances of homes are: the Adjustable Spring Door Hinge (ASDH) and the Ball Bearing Door Hinge (BBDH). Other hinge models could be considered as well. The ASDH in FIG. 2 has a safety pin measuring about one point five centimeters (1.5 cm.). Once the hinge 100 A is secured in place (attached on door 200 and door frame 200 A) and its tension is adjusted, the pin serves to hold the spring tension. The pin's socket 15 is located on one side (or in the center, depending in the position of the wings) of the upper end 13 of the barrel 19. Once the pin is placed in the pin's socket 15, it protrudes about half of its length out of the barrel 19.

For example, the security device 100 G presented in FIG. 18 to FIG. 21 includes a right side body 54 and a left side body 55, separated by the hollow "C" area 51 that is shaped in such a way as to accommodate the protruding part of the pin of about zero point seventy five centimeters (0.75 cm). Therefore, the non-roofed bottom end 60 of the hollow "C" area 51 and the lower end 56 gripping section of the security device 100 G is constructed differently from the opposite upper 57 roofed 59 end at the top end 58. Lower end 56 of the back face 53 includes a cut out 52 area to allow the accommodation of the protruding part of the pin of the hinge 100 A, without obstructing the sliding 200 H of the security device 100 G into place from the bottom upwards. For the ASDH, because of the protruding part of the pin, the sliding 200 H in FIG. 18 of the security device 100 G would be from the bottom upwards, up to the protruding pin, with the roof 59 upside down. A latch 200 G can be extended or retracted that is secured across the open space 60 A to mimic a roof 59 A of the hollow "C" area 51 gripping section, in order to impede the sliding down of the security device 100 G from the hinge 100 A since the security device 100 G has one roof 59 and it is upside down in this situation. Any other devices or features that perform as the latch 200 G could also be employing without departing from the principle of the security device 100 G.

According to additional embodiments, device 100 H in FIG. 22 to FIG. 24 and device 100 H2 in FIG. 25 to FIG. 29, are devices with a right body 62 side and a left body 63 side, separated by the hollow "C" area 66 or "HC 66" in the back face 61. Each of the right body 62 side and the left body 63 side may include ergonomically shaped grooves (e.g., rounded) for handling or gripping of the security device 100 by hand, as illustrated in FIG. 25, FIG. 29, FIG. 30, FIG. 34, FIG. 35, and FIG. 38. In the HC 66, an extra opening 67 or 32 in FIG. 5 to FIG. 17 and FIG. 22 to FIG. 32 are "cut out," except the roof 64 or 30 area, the extra opening 67 or 32 are cut out on one or both side(s) along the whole length of the hollow "C" area 66 or HC 66, with sufficient width and depth of no less than zero point seventy five centimeter (0.75 cm.), to allow the sliding 65 of the security devices 100 C, 100 C2, 100 F, 100 H, 100 H2 and 100 X from the top to the bottom without colliding with the protruding part of the pin of the barrel 19. This option will not require the need of a cut out area 52 in FIG. 18 to FIG. 21 at the lower 56 end of the security device 100 G. In other alternate embodiments, device 100 H and 100 H2 in FIG. 22 to FIG. 29, the sliding of the security devices 100 H and device 100 H2 into its place is from the top downwards 65, resting on the roof 64 of the covering part of the gripping hollow "C" area 66 or section of the security device 100 H and device 100 H. Any further improvement or modification not shown at present to accommodate the protruding part of the pin is also taken into account without departing from the principle of the security device 100.

Figure 30:
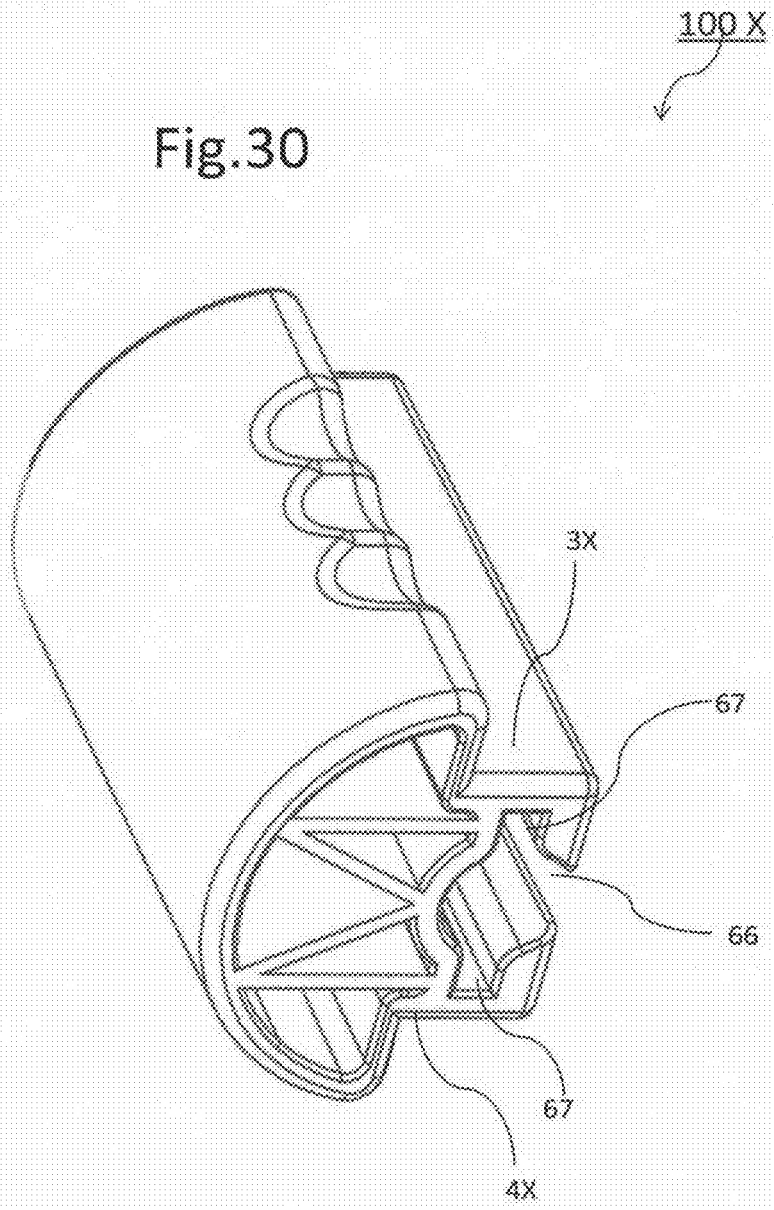
FIG. 30 illustrates a perspective view of another alternate embodiment of the present invention.
Figure 31:
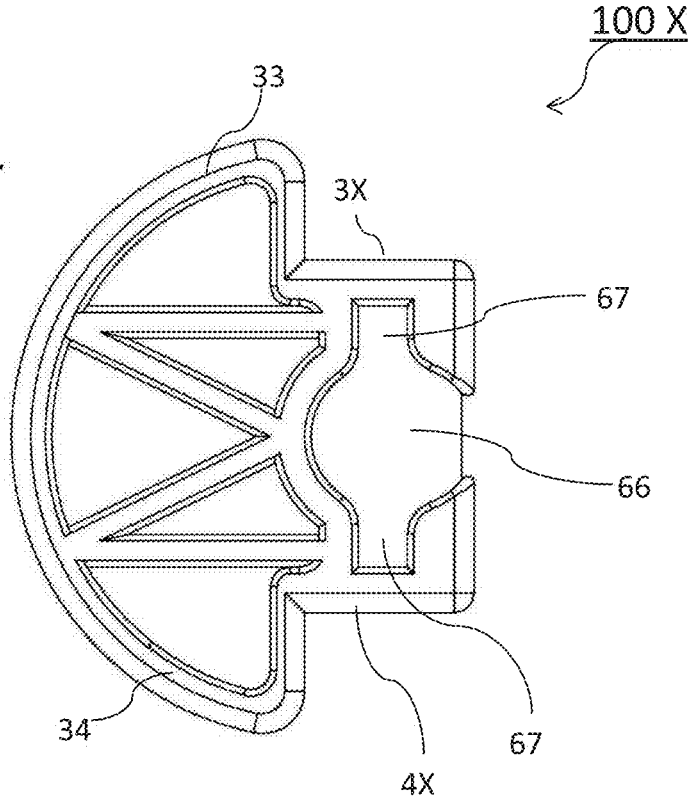
FIG. 31 illustrates a bottom view of another alternate embodiment of the present invention.
Figure 32:
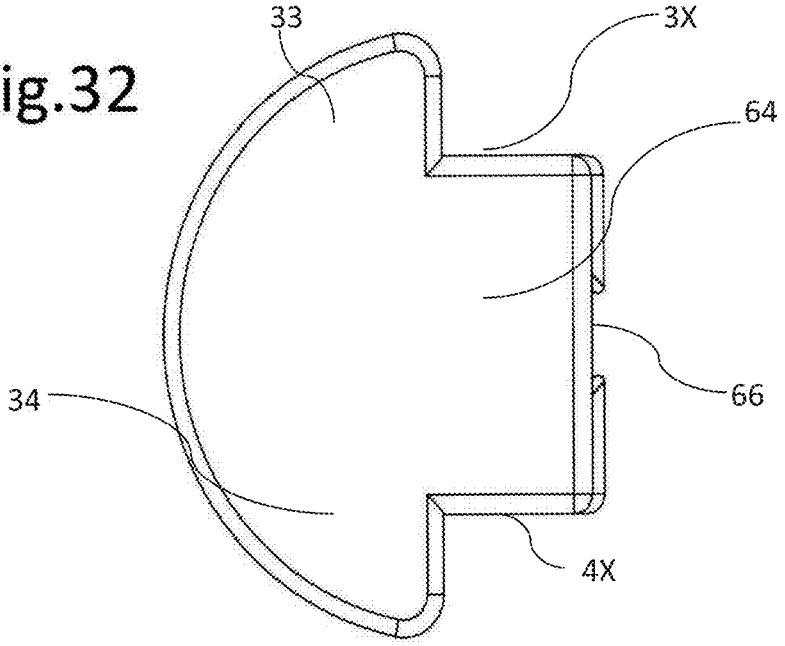
FIG. 32 illustrates a top view of another alternate embodiment of the present invention.
Figure 33:
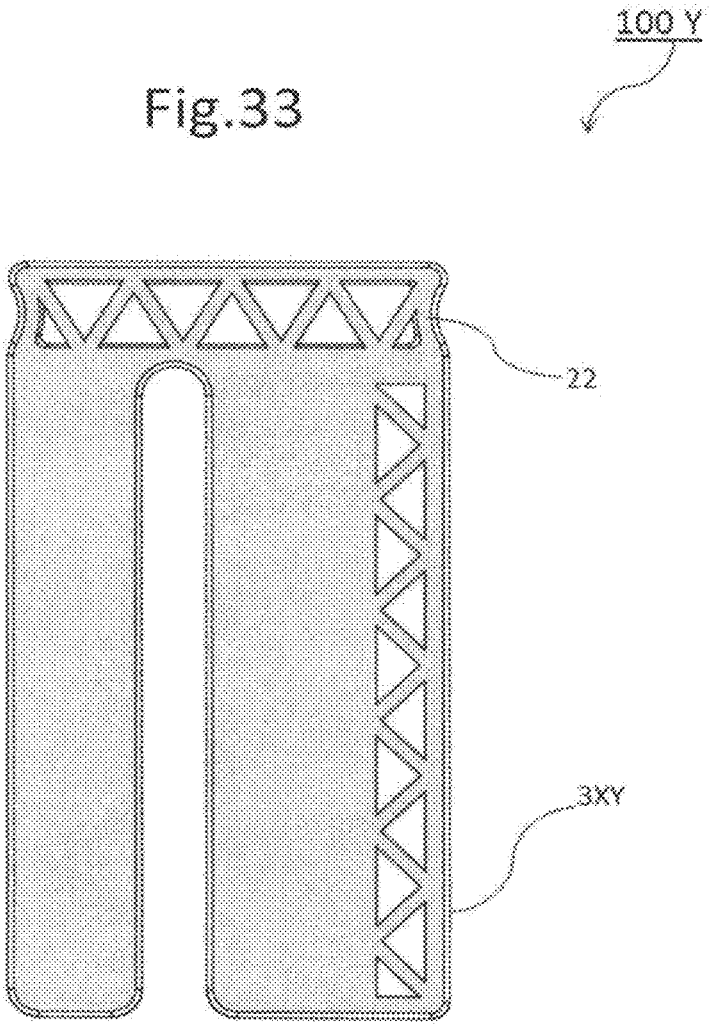
FIG. 33 illustrates a back view of another further embodiment of the present invention.

Security device 100 X is presented in FIG. 30 to FIG. 32. With reference to FIG. 1 A in which the protruding door frame molding or fixture in 202 D is performing as a perpendicular wall and the adjacent perpendicular wall 202 B is close to the hinge side door frame 202 A, the short distance 202 C extending from 202 A to the adjacent perpendicular wall 202 B is caused by a 202 A being too close to the protruding door frame molding or fixture 202 D. Distance 202 C, being of a short distance, defines the dimension of the distal door frame side 4 or side 34 section of the body, where a particular body section size might obstruct the engagement of the security device 100. The security device 100X has back side cut out sections or reduced back sections. When a larger than permissible protruding door frame molding or fixture 202 D is located in the same side of the distal door frame side section 34 of the body, the same side cut out section 4 X of the body 34 will allow the accommodation of 202 D. The device 100 X may be used when a protruding door frame molding or fixture 202 D does not permit the normal sliding placement of the device 100 over the barrel 19. A similar back side cut out or reduced section 3 X exists in the distal door side 33 section of the body of the device 100 X, which can be used in those cases that the hinges are located in the side 33 section of the body as well as the protruding door frame molding or fixture 202 D, and this side of the body becomes the distal door frame side.

Complementary device 100 Y may be used in conjunction with device 100 X. The device 100 Y presented in FIG. 33 to FIG. 38 includes a support section filler part 4 XY body section, or a support section filler part 3 XY body section, either one of these supporting sections act as a complementary section to the device 100 Y to help in the performance of the device 100 X when they are engaged.

Figure 35:
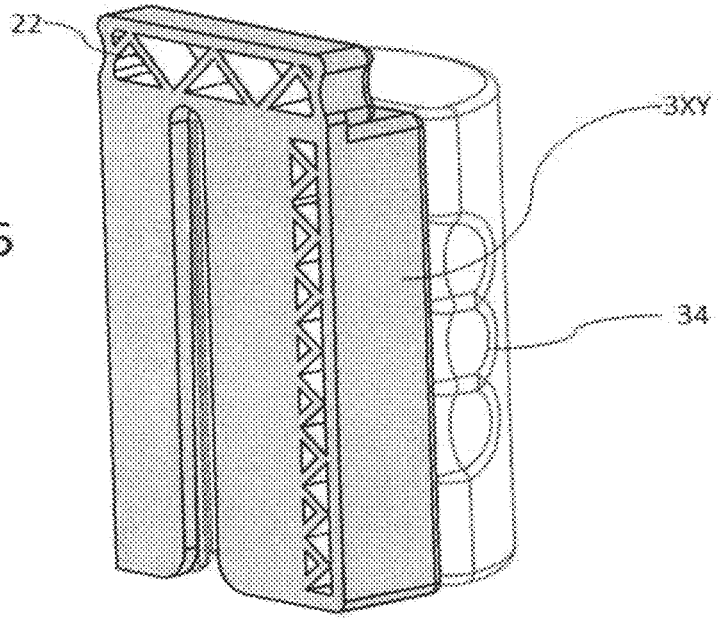
FIG. 35 illustrates a perspective view of another further embodiment of the present invention.
Figure 38:
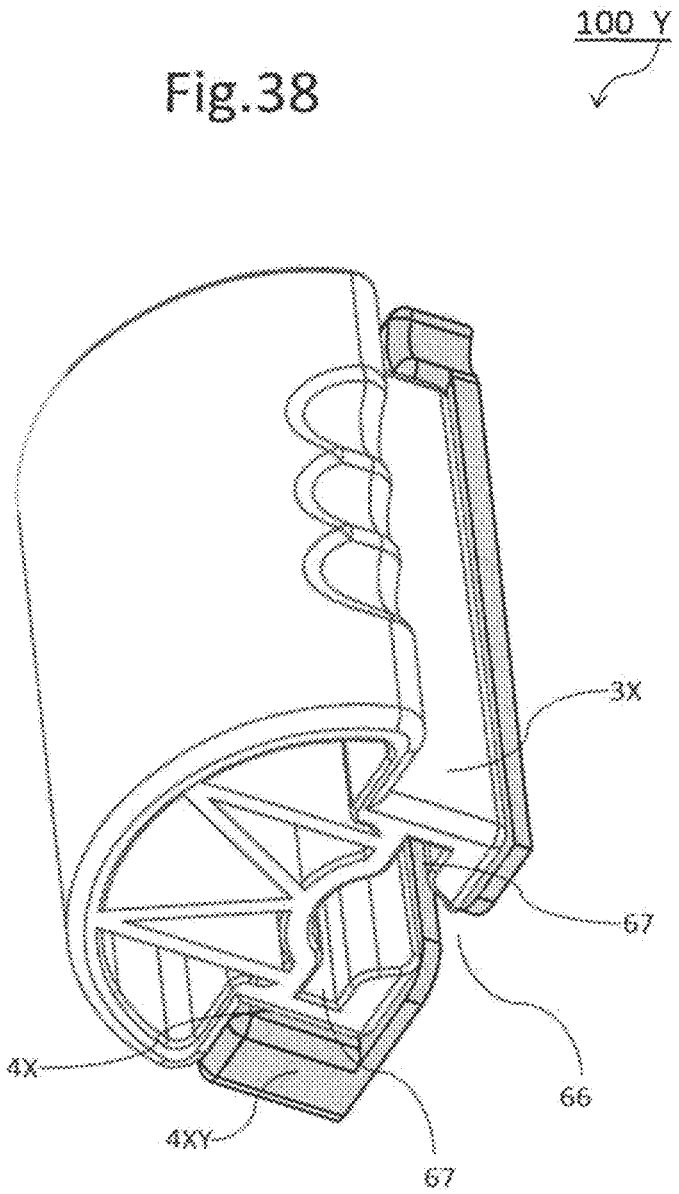
FIG. 38 illustrates a perspective view of another further embodiment of the present invention.

The two (2) versions of the device 100 Y can be used in different cases, depending on which side the door swings open. A moving door opening direction ultimately determines the location of where the hinges are being attached. When the hinges are attached to the same side of the door and the door frame, it is called the door frame side, a side that could be located in either the right side or the left side of the door and the door frame. When the hinge is located in the distal door frame side of the body 34, we use the device 100 Y containing the filler part 3 XY body section (FIG. 35). When the hinge is located in the distal door frame side of the body 33, we use the device 100 Y containing the filler part 4 XY body section (FIG. 38).

Figure 34:
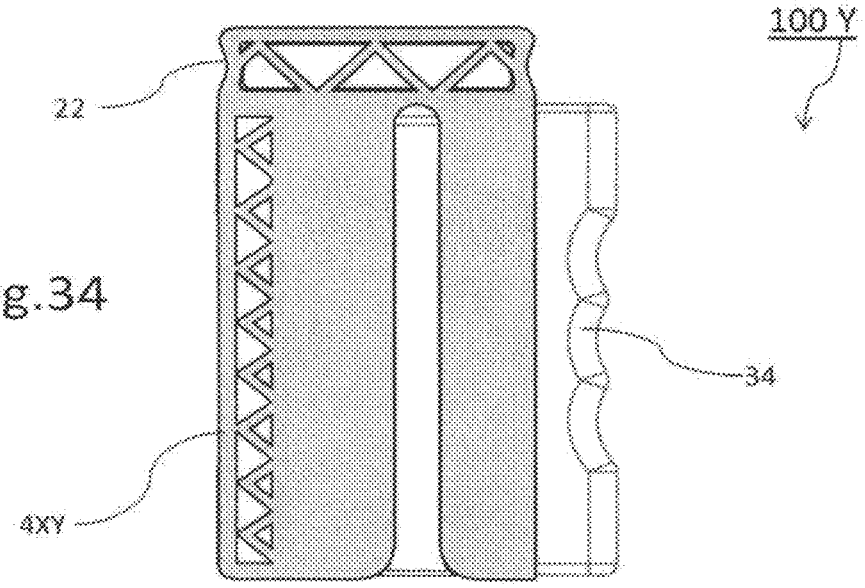
FIG. 34 illustrates a back view of another further embodiment of the present invention.
Figure 36:
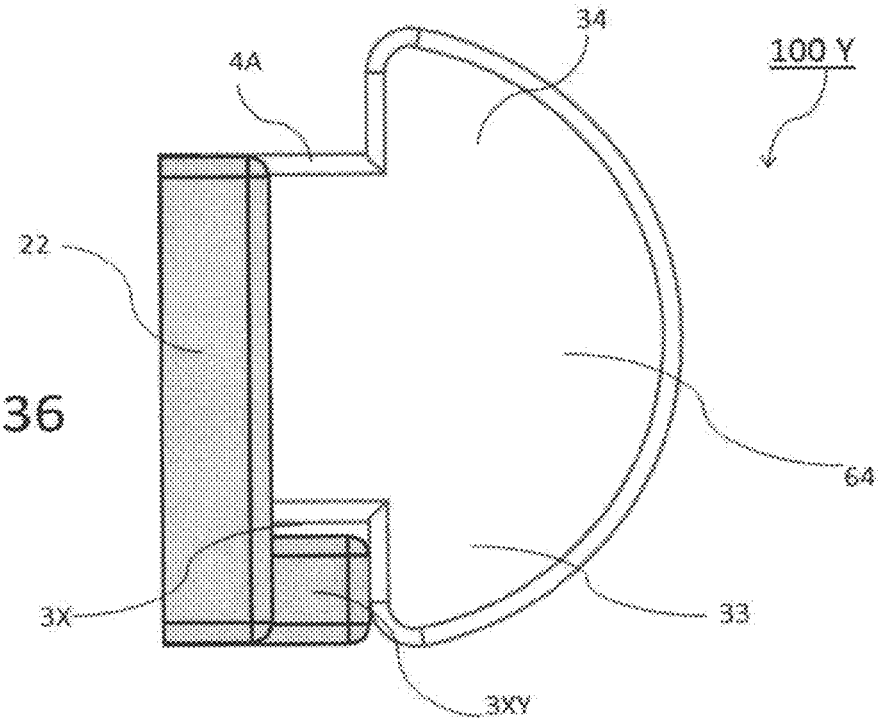
FIG. 36 illustrates a top view of another further embodiment of the present invention.
Figure 37:
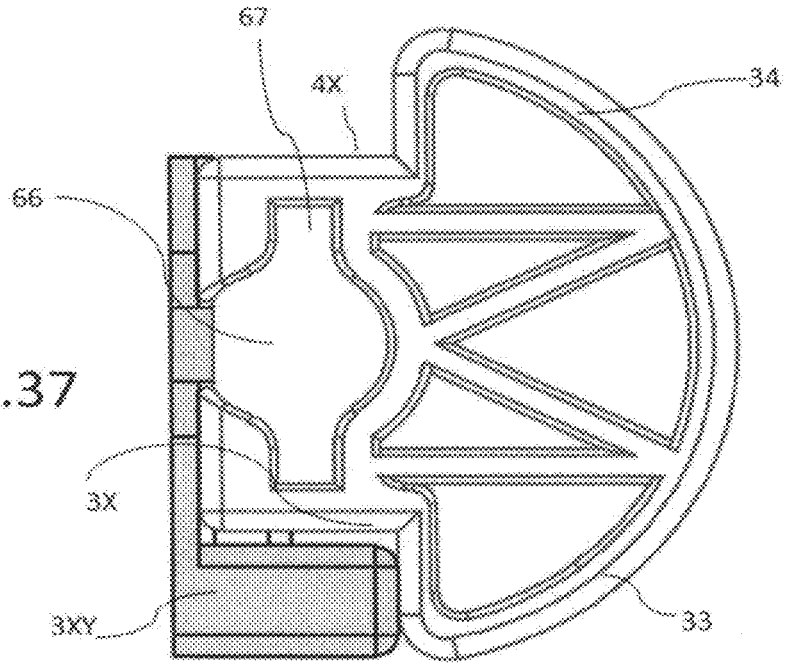
FIG. 37 illustrates a bottom view of another further embodiment of the present invention.

In addition to the functions described for device 100 B and device 100 B2 in FIG. 3 and FIG. 4, device 100 Y also acts as either a filler part 4 XY or a filler part 3 XY to add body support to the device 100 X when engaged with 100 Y, and to serve as a complementary adjuster to compensate for the cut out side or reduced body part of the device 100 X. The devices 100 Y in FIG. 35 to FIG. 37 are shown to be engaged for the case in which the device 100 Y with filler part 3 XY is coupled to the device 100 X with a back side cut out or reduced back section of the distal door side 3 X section of the body, while allowing the distal door frame side of body section 4X to accommodate an obstructing or larger than permissible protruding door frame molding or fixture 202 D. The devices 100 Y in FIG. 34 and FIG. 38, are shown with a filler part 4 XY coupled to the device 100 X with a back side cut out or reduced back section in the distal door side 4 X section of the body, while allowing the distal door frame side of the body section 3 X to accommodate the larger than permissible protruding door frame molding or fixture 202 D.

A BBDH does not possess any protruding pin; therefore any gripping hollow "C" area 6, 31, 51 or 66 or any device 100, 100 C, 100 C2, 100 F, 100 G, 100 H or 100 H2 could be used to slide the device in place from the top downwards, resting on the roof of the covering part of any gripping hollow "C" area from any one of the security devices herein presented.

Any other modifications made to any commercially available hinges 100 A will follow with modifications to the security device 100 without departing from its original principle.

Figures 39, 40, 41:
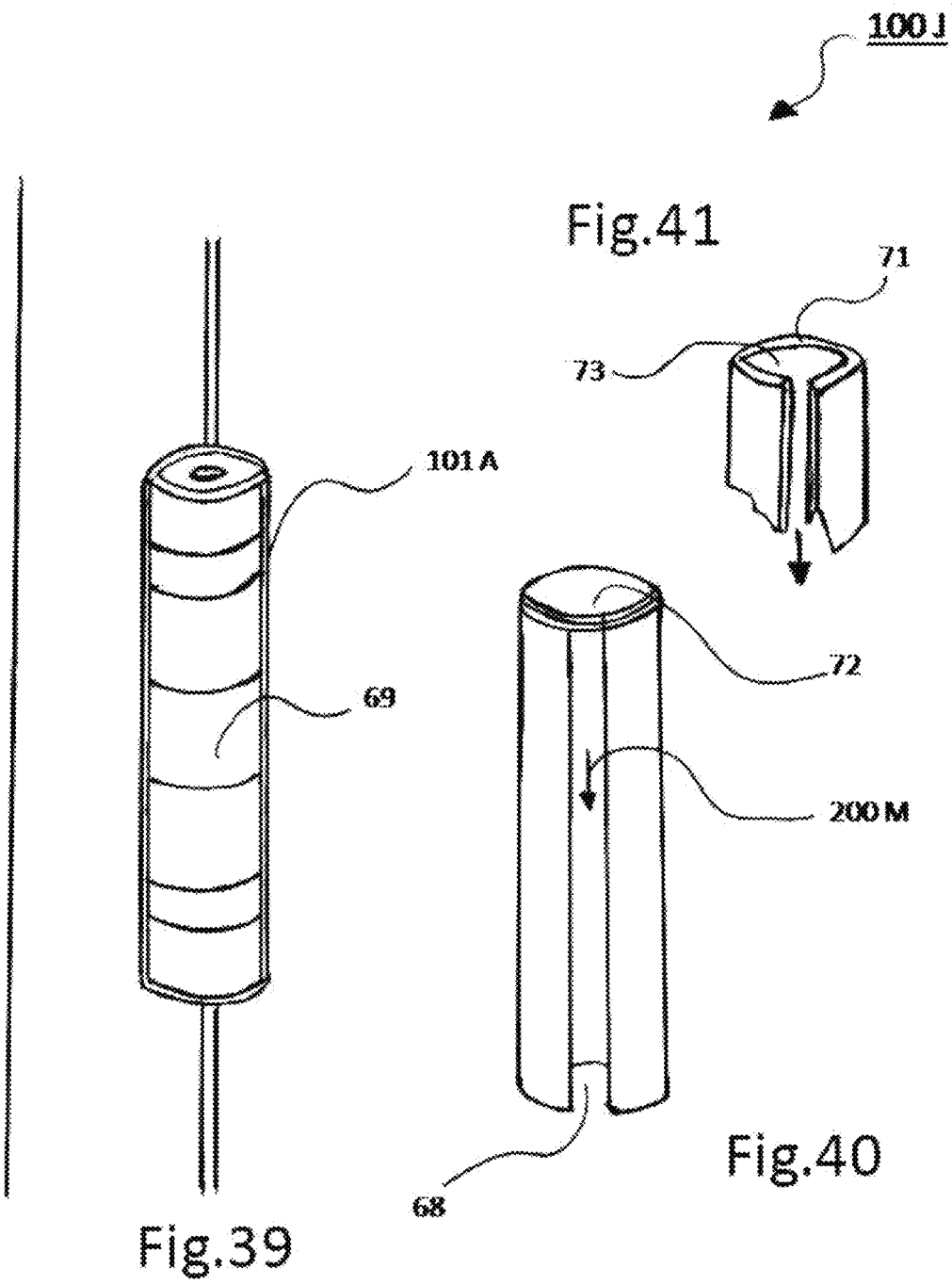
FIG. 39 illustrates a perspective front view of a related element for an embodiment of the present invention.
FIG. 40 illustrates a perspective back view of another aspect of the present invention.
FIG. 41 illustrates a perspective back view of a further aspect of the present invention.

The security devices 100, 100 C, 100 C2, 100 F, 100 G, 100 H or 100 H2 could also be used for smaller hinges 101 A in FIG. 39, without having to manufacture a variety of different sizes of the security devices. A hinge barrel augmenter (HBA) 100 J in FIG. 40 and FIG. 41 or HBA 100 J could be added over the length of the barrel 69 in FIG. 22 to reduce the movable empty space 7 in FIG. 1 inside the hollow "C" area 6, 31, 51 or 66 by increasing the thickness of the barrel 69 by adding the hinge barrel augmenter 100 J. The hinge barrel augmenter 100 J has an inward edge 71 (border, rim) in one end of its two hollow 73 ends, or has a roof 72 instead, in which case, there is only one hollow bottom 68 end, and the roof 72 functions as well as the edge 71 as a retainer or stopper of the hinge barrel augmenter 100 J, to impede it from sliding down 200 M the barrel when placed in place.

Figure 42:
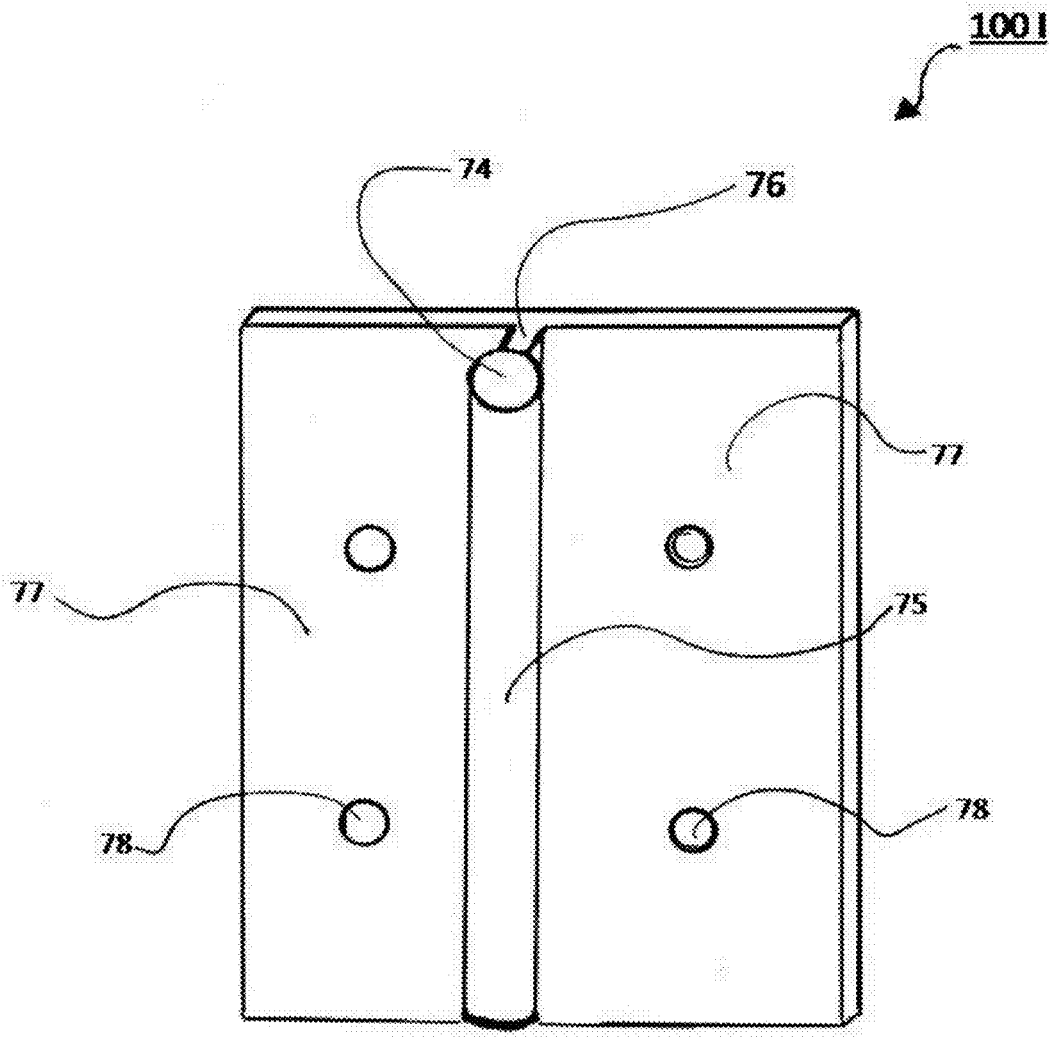
FIG. 42 illustrates a perspective front view of another aspect of the present invention.

Another aspect of the present invention includes a complementing device holder 100 I, presented in FIG. 42, for the usage of the devices 100, 100 C, 100 C2, 100 F, 100 G, 100 H and 100 H2. It comprises a cylinder 74 resembling a smaller barrel 75, attached 76 to a base support 77 approximately about the same size of the devices 100 C, 100 C2, 100 F, 100 G, 100 H and 100 H2, to allow the hollow "C" 6, 31, 51 and area 66 of the devices to slide over. Several holes 78 are provided for securing the device holder 100 I onto the wall, such as inside of the door, or in any other area close to the door 200. All of the above described devices could be made from metal, hard plastic, metal alloy, or any other suitable materials or combination of materials.

FIGS. 1 through 42 are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A portable door guard apparatus for sliding over a hinge of a door, the portable door guard apparatus comprising:

a body comprising a hollow cylindrical section having a length between a top end and a bottom end, the cylindrical section including an opening gap extending along the length of the hollow cylindrical section between the top and bottom ends of the cylindrical section, facing outward from a planer stationary section of a back face of the body opposite a front face of the body, the hollow cylindrical section comprising a closed top end, an open bottom end, and a "C" shaped profile that allows the body to receive a barrel of the hinge in the open bottom end and slide parallel with regard to the barrel up to the closed top end and resist lateral sliding of the body away from the barrel, wherein the hinge comprises the barrel, a first wing, and a second wing, the first wing operates to engage the hinge to a door frame, and the second wing operates to engage the hinge to the door, and the barrel holding the first wing and the second wing together at a pivot, the "C" shaped profile dimensioned to maintain a space between the planer stationary section of the back face of the body and the door when installed over the hinge;

at least one section of the body is adjacent to the hollow cylindrical section and has the planer stationary section thereon configured substantially parallel to and projecting over a face of the door when installed over the hinge for the back face of the body to abut against the door to therewith impede the door from opening more than a given amount; and a support section filler part removably coupled with the at least one section of the body, the support section filler part having a lengthwise slot therein in line with the opening gap of the body allowing the support section filler part to slide parallel with the hinge, between the back face of the body and the door, the support section filler part further having a tapered cross section having a thickness that increases from a bottom end to a top end of the filler part body to close the space between the planer stationary section of the back face of the body and the door as the filler part is progressively lowered on the hinge, and a section extending out from the tapered cross section that abuts against at least one back side cut out section in the body to limit lateral movement of the filler part in relation to the body.

2. The portable door guard apparatus of claim 1 wherein the at least one body section comprises:

at least one movable back face section coupled to a movable center operative to protrude and withdraw relative to the stationary section of the back face; and an adjusting means on a front face section of the body for adjusting the protruding and withdrawing of the at least one movable back face section.

3. The portable door guard apparatus of claim 2, wherein the adjusting means further comprises a handle.

4. The portable door guard apparatus of claim 2 wherein the body further comprises a left section of the body and a right section of the body that are adjacent to the hollow cylindrical section.

5. The portable door guard apparatus of claim 4 wherein at least one of the left body and the right body include the movable back face section.

6. The portable door guard apparatus of claim 5 further including a latch at the bottom end of the back face of the body operative to extend and retract across an open space of the bottom end of the back face.

7. The portable door guard apparatus of claim 2 including a base attached to the movable back face section via one or more spring coils.

8. The portable door guard apparatus of claim 7 wherein the adjusting means is configured to distend the one or more spring coils for the protrusion of the at least one of the movable back face section perpendicularly away from the stationary section of the back face.

9. The portable door guard apparatus of claim 2 wherein the adjusting means protrudes through a threaded aperture in the front face section.

10. The portable door guard apparatus of claim 9 wherein the barrel augmenter includes an inward edge in one end operative as a stopper of the barrel augmenter.

11. The portable door guard apparatus of claim 2 wherein an inner end of the adjusting means is in contact with a contact area of a base coupled to the movable center.

12. The portable door guard apparatus of claim 1 further including a roof on the top end operative as a reinforcement and stopper of the hollow cylindrical section.

13. The portable door guard apparatus of claim 1 wherein the portable door guard apparatus is configurable with a barrel augmenter that is provided along a length of the barrel to increase the thickness of the barrel.

14. The portable door guard apparatus of claim 1 wherein the portable door guard apparatus is configurable with a device holder attached to a base support to allow the hollow cylindrical section to slide over the device holder.

15. The portable door guard apparatus of claim 1 wherein the at least one body section comprises at least one back side cut out section to accommodate a protruding door frame molding or fixture.

16. The portable door guard apparatus of claim 15 wherein the at least one body section is configurable with a support section filler part.

17. The portable door guard apparatus of claim 16 wherein the support section filler part is configured to compensate for the at least one back side cut out section.

18. The portable door guard apparatus of claim 1 comprising a rounded front face, a left body side and a right body side wherein the left body side and the right body side includes rounded shaped grooves.

* * * * *